US010125961B2

(12) United States Patent
Slosberg et al.

(10) Patent No.: US 10,125,961 B2
(45) Date of Patent: Nov. 13, 2018

(54) PLATFORM TO INTEGRATE SENSORS INTO LIGHT BULBS

(71) Applicants: Jason Slosberg, Monteclair, NJ (US); Nagendra Cherukupalli, Cupertino, CA (US); Michael R. Loeb, New York, NY (US)

(72) Inventors: Jason Slosberg, Monteclair, NJ (US); Nagendra Cherukupalli, Cupertino, CA (US); Michael R. Loeb, New York, NY (US)

(73) Assignee: Linkbee, LLC, New York, NY (US)

( * ) Notice: Subject to any disclaimer, the term of this patent is extended or adjusted under 35 U.S.C. 154(b) by 282 days.

(21) Appl. No.: 14/952,150

(22) Filed: Nov. 25, 2015

(65) Prior Publication Data

US 2017/0146197 A1 May 25, 2017

(51) Int. Cl.

| | |
|---|---|
| ***F21V 23/04*** | (2006.01) |
| ***F21V 3/02*** | (2006.01) |
| ***F21V 17/02*** | (2006.01) |
| ***H05B 33/00*** | (2006.01) |
| ***F21K 9/232*** | (2016.01) |
| *F21V 33/00* | (2006.01) |
| *F21Y 115/10* | (2016.01) |

(52) U.S. Cl.

CPC ..... *F21V 23/045* (2013.01); *F21K 9/232* (2016.08); *F21V 3/02* (2013.01); *F21V 17/02* (2013.01); *H05B 33/00* (2013.01); *F21V 33/0076* (2013.01); *F21Y 2115/10* (2016.08)

(58) Field of Classification Search

CPC ..... F21V 23/045; F21V 3/02; F21V 17/02; F21V 33/0076; F21K 9/232; H05B 33/00; F21Y 2115/10

See application file for complete search history.

(56) References Cited

U.S. PATENT DOCUMENTS

| | | | | |
|---|---|---|---|---|
| 8,711,216 B2 * | 4/2014 | Chien | H04N 5/2354 | 348/142 |
| 2010/0141153 A1 * | 6/2010 | Recker | H05B 33/0803 | 315/149 |

* cited by examiner

*Primary Examiner* — Mary Ellen Bowman

(74) *Attorney, Agent, or Firm* — Buckley, Maschoff & Talwalkar LLC

(57) ABSTRACT

According to some embodiments, a light bulb may include a base adapted to be coupled to a power socket, lighting circuitry supporting at least one lighting element to provide illumination, a communication element to exchange information with at least one remote device, and a receiving portion. An extendable sensor mount may include a first end attached to be attached to the receiving portion of the light bulb and a second end, opposite the first end, extendable with respect to the light bulb. A sensor may be coupled to the second end of the extendable sensor mount, and data collected by the sensor may be transmitted to the at least one remote device via the communication element of the light bulb.

14 Claims, 25 Drawing Sheets

2400

| NETWORK ID 2402 | LIGHT FIXTURE ID 2404 | DESCRIPTION 2406 | SENSORS 2408 | STATUS 2410 |
|---|---|---|---|---|
| N_101 | LF_101.1 | SMITH CORPORATION (MODEL 123) | MOTION (WITH ESM) | ON |
| N_101 | LF_101.2 | BEDROOM | TEMPERATURE (WITH ESM) | OFF |
| N_101 | LF_101.3 | INSTALLED 3/3/2019 | MOTION, SOUND | STANDBY |
| N_101 | LF_101.4 | SMITH CORPORATION (MODEL 125) | MOTION | ON - DIM |

*FIG. 24*

PLATFORM TO INTEGRATE SENSORS INTO LIGHT BULBS

FIELD OF THE INVENTION

In general, the invention relates to a computerized system and method providing a platform to integrate sensors into light bulbs in light fixture networks.

BACKGROUND OF THE INVENTION

A user might want to have one or more sensor located throughout his or her home. For example, a user might find it useful to have motion sensors positioned in various rooms of his or her house (e.g., to automatically turn on or off lights, air conditioning, etc.). It can be difficult, however, to provide a suitable number of sensors throughout a residence (e.g., the devices typically need a source of power, a way to communicate with other, etc.). In some cases, a sensor may be provided as part of a light bulb. For example, FIG. 1 is an example 100 of a light bulb 110 having a sensor 160. The sensor 160 may, for example, detect motion, temperature, etc. FIG. 2 illustrates a room 200 wherein such a light bulb 210 with a sensor 260 is installed in a recessed lighting fixture 292 in the ceiling 294 of the room 200. When the light bulb 210 is mounted in the recessed lighting fixture 292, the sensor 260 may be naturally located such that it has a good field of view 262 that covers substantially all of the room 200 (e.g., from the ceiling 294 to the floor 296 and from wall 298 to wall 298).

In some cases, however, such a result may be more difficult to achieve. For example, FIG. 3 illustrates a room 300 wherein a light bulb 310 with a sensor 360 is installed in a deeper recessed lighting fixture 392 in the ceiling 394 of the room 300. Because the recess is deeper, when the light bulb 310 is mounted in the recessed lighting fixture 392, the sensor 360 may be positioned such that it has a poor field of view 362 that does not cover substantially all of the room 300 (e.g., from the ceiling 394 to the floor 396 and from wall 398 to wall 398). Similar problems might arise with lamp shades, track lighting installations, floor lamps that are primarily designed to provide illumination toward the ceiling 394, etc.

It may therefore be desirable to provide sensors for light bulbs in an efficient and useful manner.

SUMMARY

Therefore, there is a need in the art for ways to provide sensors for light bulbs in an efficient and useful manner. According to some embodiments, a light bulb may include a base adapted to be coupled to a power socket, lighting circuitry supporting at least one lighting element to provide illumination, a communication element to exchange information with at least one remote device, and a receiving portion. An extendable sensor mount may include a first end attached to be attached to the receiving portion of the light bulb and a second end, opposite the first end, extendable with respect to the light bulb. A sensor may be coupled to the second end of the extendable sensor mount, and data collected by the sensor may be transmitted to the at least one remote device via the communication element of the light bulb.

Some embodiments may be associated with: means for selecting an information exchange element from a plurality of potential information exchange elements of different types; means for coupling the information exchange element to a second end of an extendable information exchange element mount, the extendable information exchange element mount having a first end opposite the second end; means for attaching the first end of the extendable information exchange element mount to a receiving portion of a light bulb; means for coupling a base of the light bulb to a power socket; and means for adjusting a position of the information exchange element with respect to the light bulb.

According to another aspect, the invention relates to computerized methods for carrying out the functionalities described above. According to another aspect, the invention relates to non-transitory computer readable medium having stored therein instructions for causing a processor to carry out the functionalities described above.

BRIEF DESCRIPTION OF THE DRAWINGS

FIG. 24 is a tabular portion of a network database in accordance with some embodiments.

DESCRIPTION OF CERTAIN ILLUSTRATIVE EMBODIMENTS

To provide an overall understanding of the invention, certain illustrative embodiments will now be described, including systems and methods to facilitate the use of sensors in a residence or other building structure via light fixtures. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope thereof.

Figure 1:
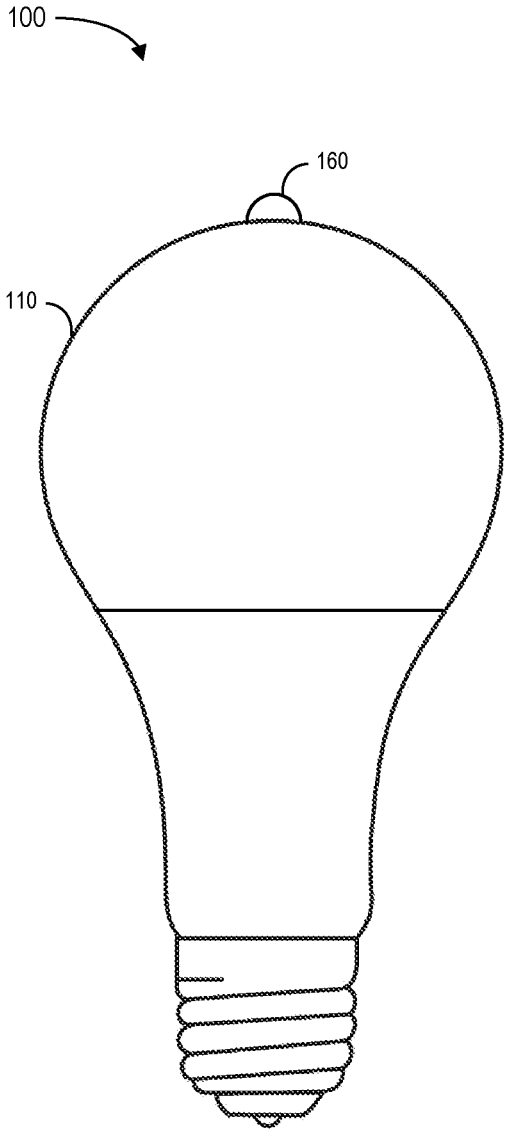
PRIOR ART FIG. 1
FIG. 1 is an example of a light bulb with a sensor.
Figure 2:
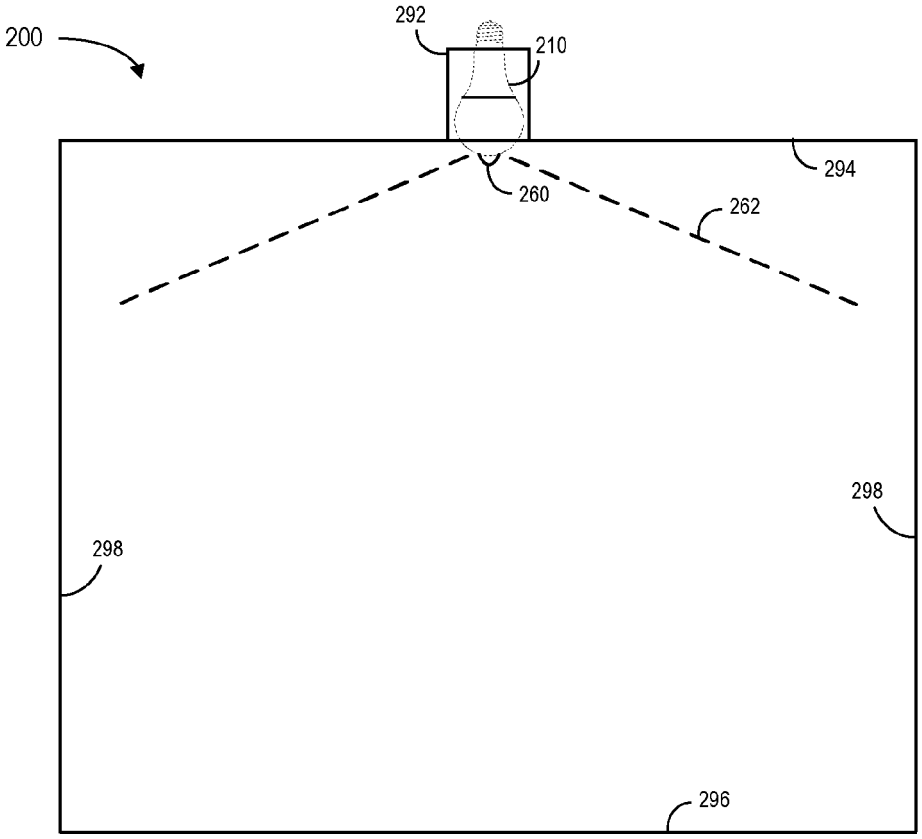
PRIOR ART FIG. 2
FIG. 2 is a room wherein a light bulb with a sensor is mounted in a recessed lighting fixture.
Figure 3:
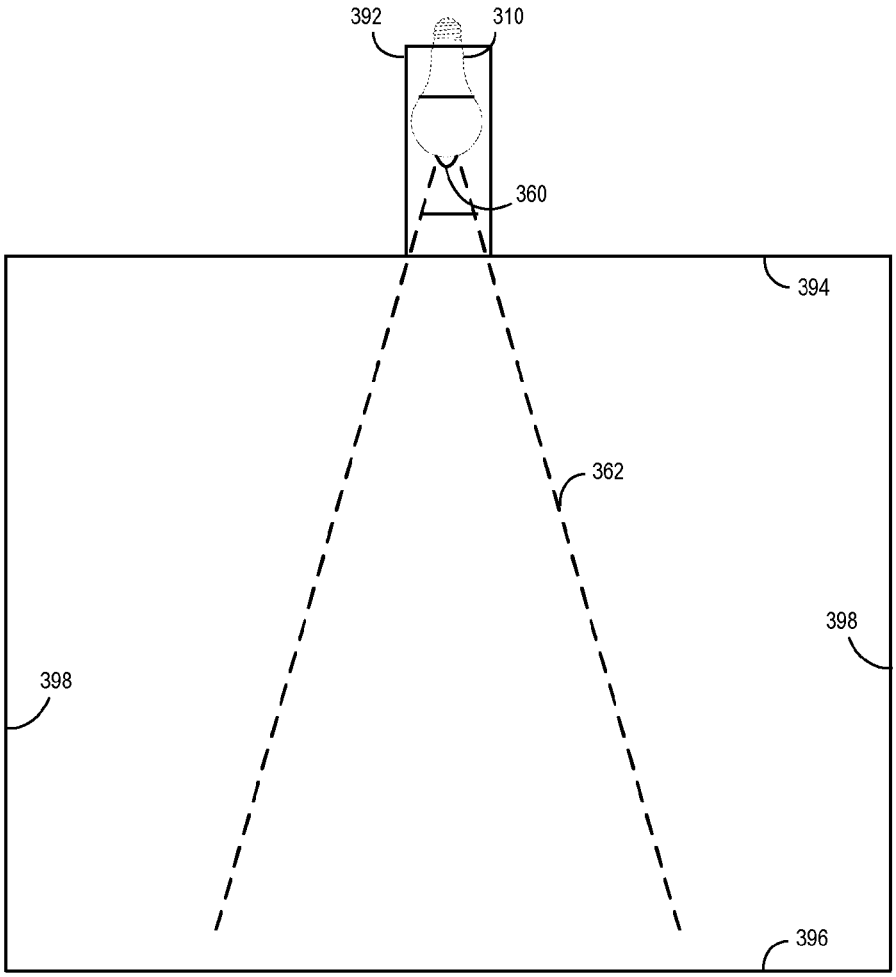
PRIOR ART FIG. 3
FIG. 3 is a room wherein a light bulb with a sensor is mounted in a deeper recessed lighting fixture.
Figure 4:
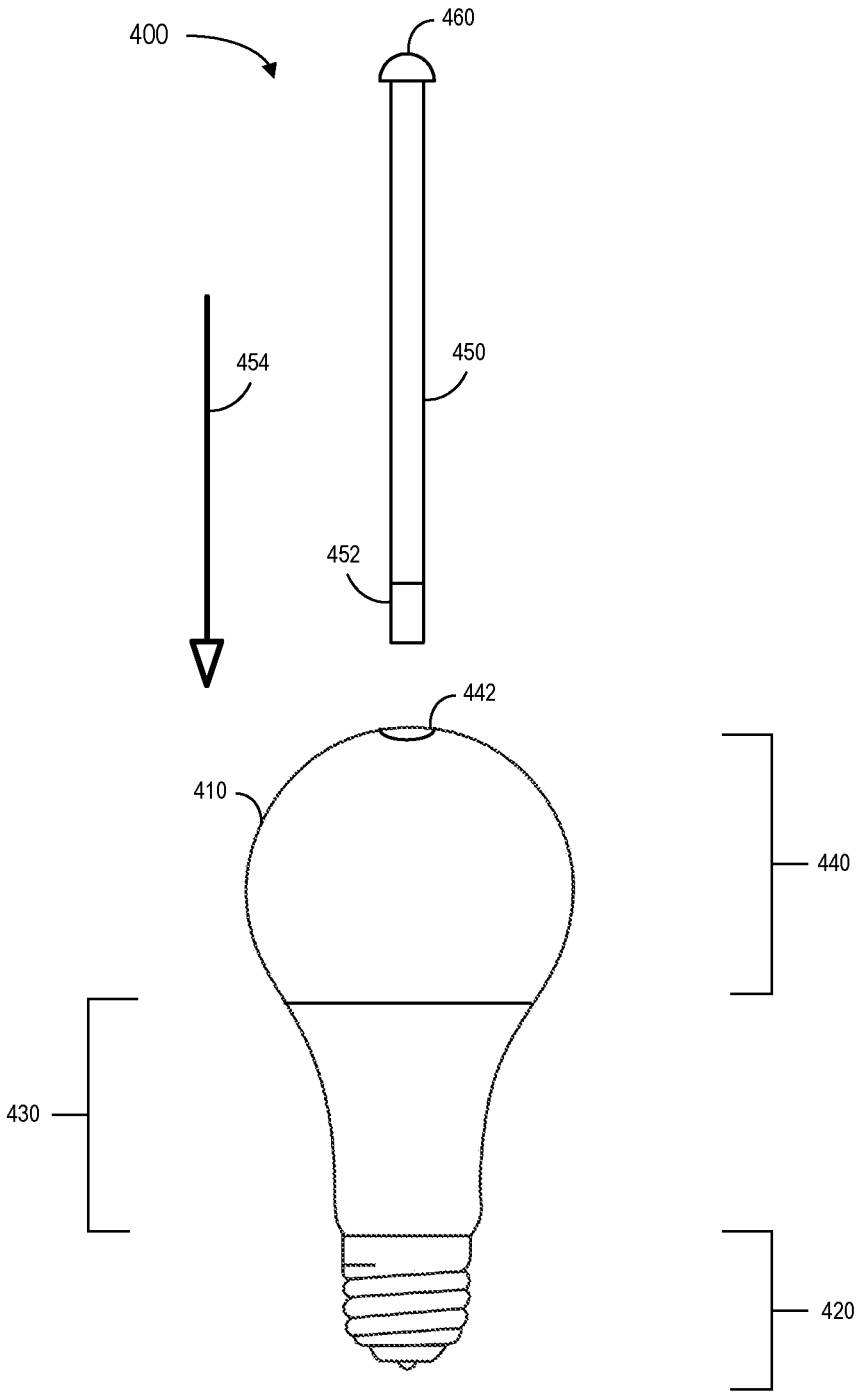
FIG. 4 is a system in accordance with some embodiments of the invention.

FIG. 4 is a system 400 in accordance with some embodiments of the invention. In particular, the system 400 includes a light bulb 410, including a base 420 adapted to be coupled to a power socket, a body 430 (e.g., to house lighting circuitry supporting at least one lighting element to provide illumination, a communication element to exchange information with at least one remote device, etc.), and a cover 440 with an opening 442. The system 100 further includes an extendable sensor mount 450 including a first end 452 to be attached to a receiving portion of the light bulb 410, and a second end, opposite the first end 452, extendable with respect to the light bulb. For example, a sensor 460 may be coupled to the second end of the extendable sensor mount 450. As used herein, the term "sensor" may refer to any device adapted to collect information, such as a Passive Infra-Red ("PIR") motion sensor, a microphone, an ambient light sensor, a temperature sensor, a humidity sensor, an air quality sensor, an allergen sensor, a carbon dioxide ($CO_2$) sensor, a smoke detector, a camera, a video camera, an Infra-Red ("IR") camera, xiii) a Forward Looking Infra-Red ("FLIR") thermographic camera, a mold spore sensor, etc. Note that the sensor 460 may be powered via the base 420 when coupled to the power socket (e.g., avoiding the need to use a battery or to install specially wiring in the residence).

According to some embodiments, the lighting element is associated with an energy efficient Light Emitting Diode ("LED") light fixture and the at least one remote device is associated with: a user communication hub co-located with a light fixture network, including the light bulb 110; or one of the plurality of light fixtures wherein the light fixture network, including the light bulb 110, comprises a mesh network topology. Moreover, according to some embodiments, the communication element is associated with: a wireless communication device; or a device that communicates via the base 420 when coupled to the power socket (e.g., via a house's electrical wiring).

Figure 5:
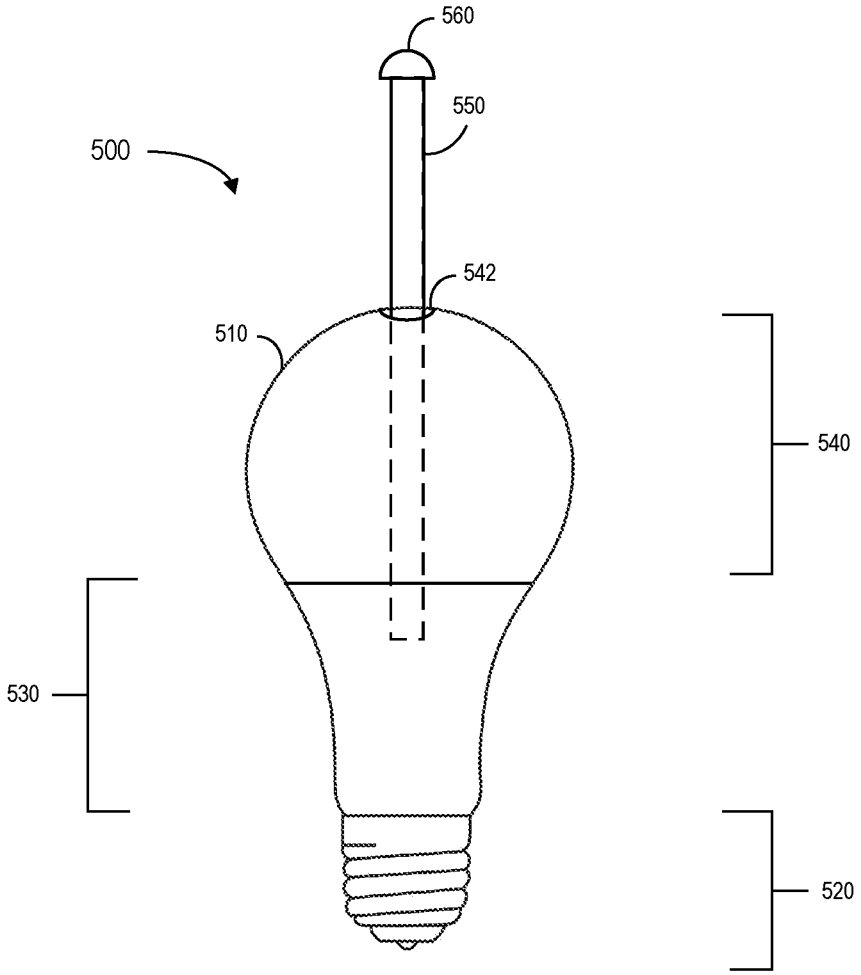
FIG. 5 is a system wherein the mount has been inserted into the bulb in accordance with some embodiments of the invention.

The system 400 of FIG. 4 may be arranged such that the extendable sensor mount 450 is to be inserted through the opening 442 in the cover 440 of the light bulb 410 (e.g., along the line of motion 454 illustrated in FIG. 4). FIG. 5 is a system 500 wherein the extendable sensor mount 550 (with a removable sensor 560) has been inserted into the light bulb 510 in accordance with some embodiments of the invention. As before, the light bulb 510 includes a base 520 (to receive power), a body 530, and a cover 540 with an opening 542. The body 530 may, for example, include a receiving portion to mate with the first end of the extendable sensor mount 550. The receiving portion might be, for example, associated with a heat sink, an anchor attached to the body 530 of the light bulb 510, a threaded socket, and/or a prong receiving socket. As will be described in connection with the various embodiments disclosed herein, the second end of the extendable mounting portion 550 might be "extendable" with respect to the light bulb 510 via one or more degrees of freedom providing an ability to be positioned away from the light bulb 510, a telescoping movement, a hinge or pivot element, and/or a flexible portion. According to some embodiments, a plurality of sensors of different types might be coupled to the second end of the extendable sensor mount 550 (e.g., a thermometer and a humidity sensor). Note that the system 500 may act as a platform to integrate various types of sensors into light bulbs and light fixture networks.

Figure 6:
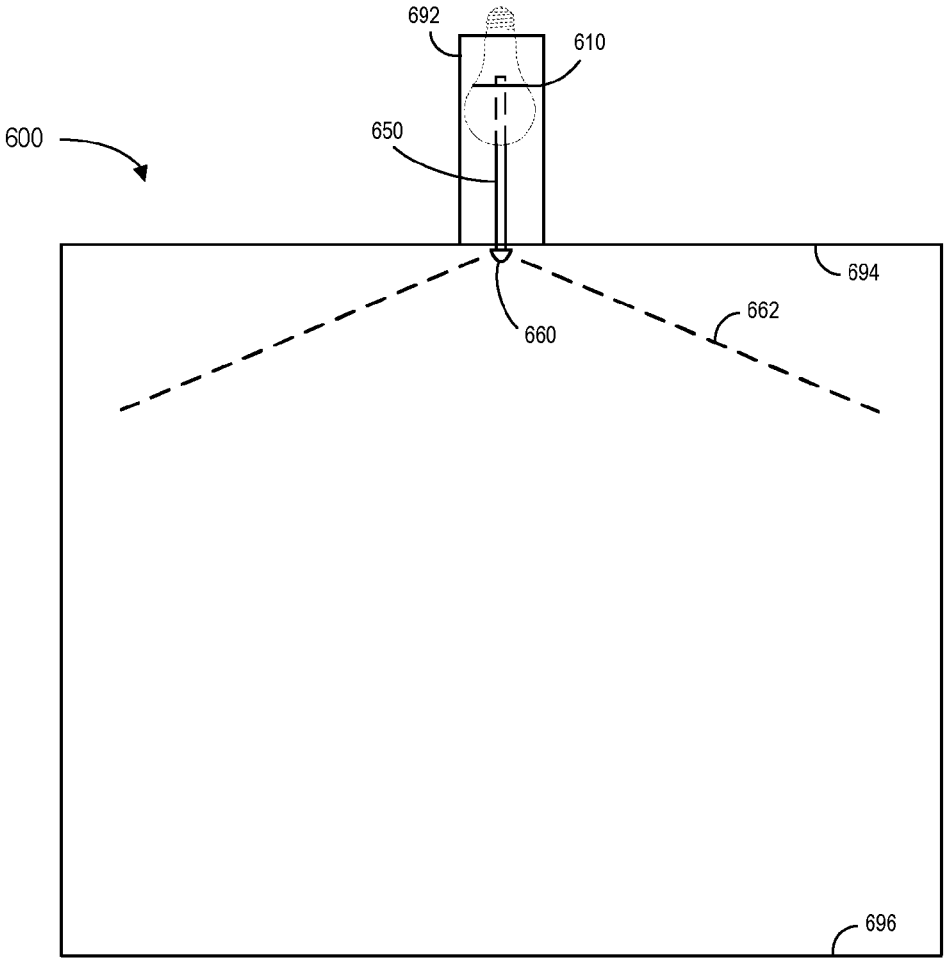
FIG. 6 is a room wherein a light bulb with a sensor is mounted in a deeper recessed lighting fixture in accordance with some embodiments of the invention.

FIG. 6 is a room 600 wherein a light bulb 610 with a sensor 660 is mounted in a deeper recessed lighting fixture 692 in accordance with some embodiments of the invention. Even though the recess is relatively deep, when the light bulb 610 is mounted in the recessed lighting fixture 692 (e.g., by a professional installer or any other party), the extendable sensor mount 650 (e.g., adjustable in some way with respect to one or more degrees of freedom as opposed to being static) lets the sensor 660 be positioned such that it has a good field of view 562 that covers substantially the entire room 600 (e.g., from the ceiling 394 to the floor 396 and from wall 398 to wall 398). Similar advantages might be found in connection with lamp shades, track lighting installations, floor lamps that are primarily designed to provide illumination toward the ceiling 694, etc. In this way, an appropriate amount of data collected by the sensor 660 can be transmitted to the at least one remote device via the communication element. Although the example of FIG. 6 involves a sensor 660 located near the ceiling 694 and pointing to the floor 969, similar benefit may be provided when a bulb 610 directs illumination toward the ceiling 694, toward one or more of the walls, etc.

Figure 7:
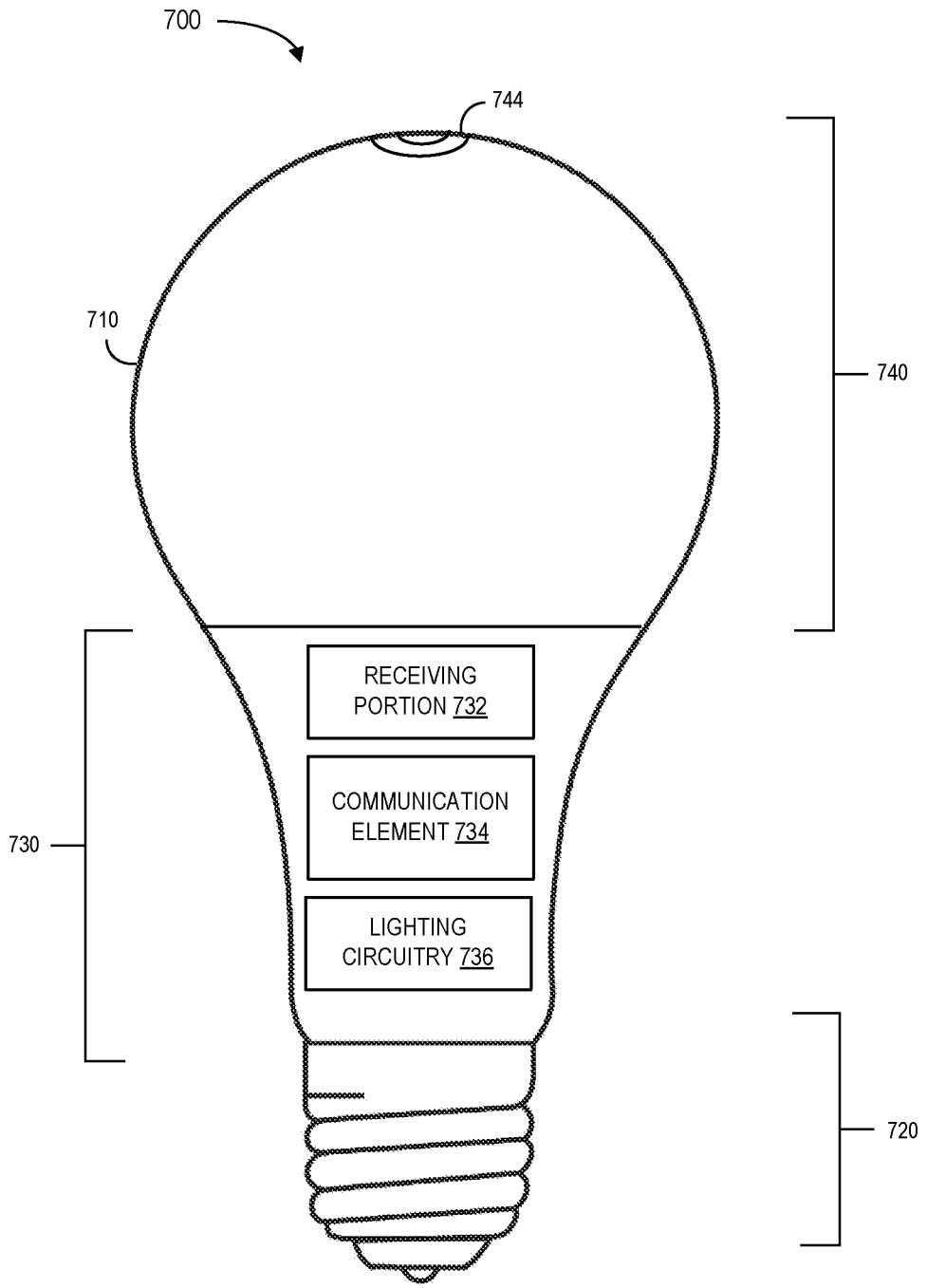
FIG. 7 is a modular system in accordance with some embodiments of the invention.

FIG. 7 is a modular system 700 in accordance with some embodiments of the invention. The modular system 700 includes a light bulb 710, including a base 720 adapted to be coupled to a power socket, a body 730, and a cover 740 with an opening to receive an extendable sensor mount. According to this embodiment, the opening in the cover 740 includes a flexible, rubber-like seal 744 (e.g., to prevent moisture and dust from entering the cover while still allowing for insertion of an extendable sensor). The body 730 of the light bulb 710 may include one or more standard components that can be used with different types of sensors, such as a receiving portion 732 (e.g., to receive and hold an extendable sensor mount), a communication element 734 (e.g., to wirelessly transmit data collected by a sensor), and/or lighting circuitry 736 (e.g., to operate a high efficiency LED element).

Figure 8:
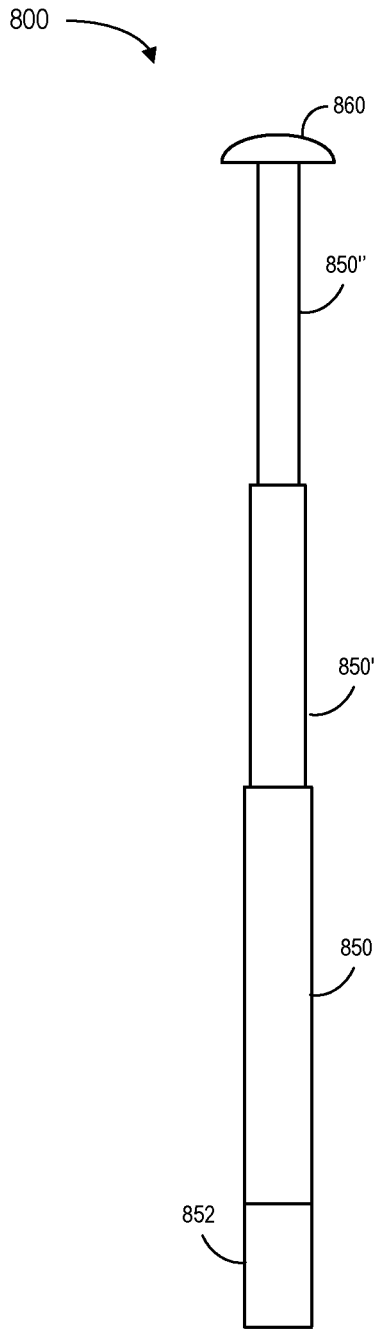
FIG. 8 is a telescoping system in accordance with some embodiments of the invention.

Note that various degrees and types of freedom of movements between a sensor and a light bulb might be provided in accordance with embodiments described herein. For example, FIG. 8 is a telescoping system 800 in accordance with some embodiments of the invention. In this system 800, the extendable sensor mount 850 includes a mounting portion 852 opposite a sensor 860. Moreover, a plurality of telescoping portions 850', 850" are provided such the sensor 860 may be moved away from, or closer to, a light bulb cover (e.g., depending on the depth of a recessed lighting fixture).

Figure 9:
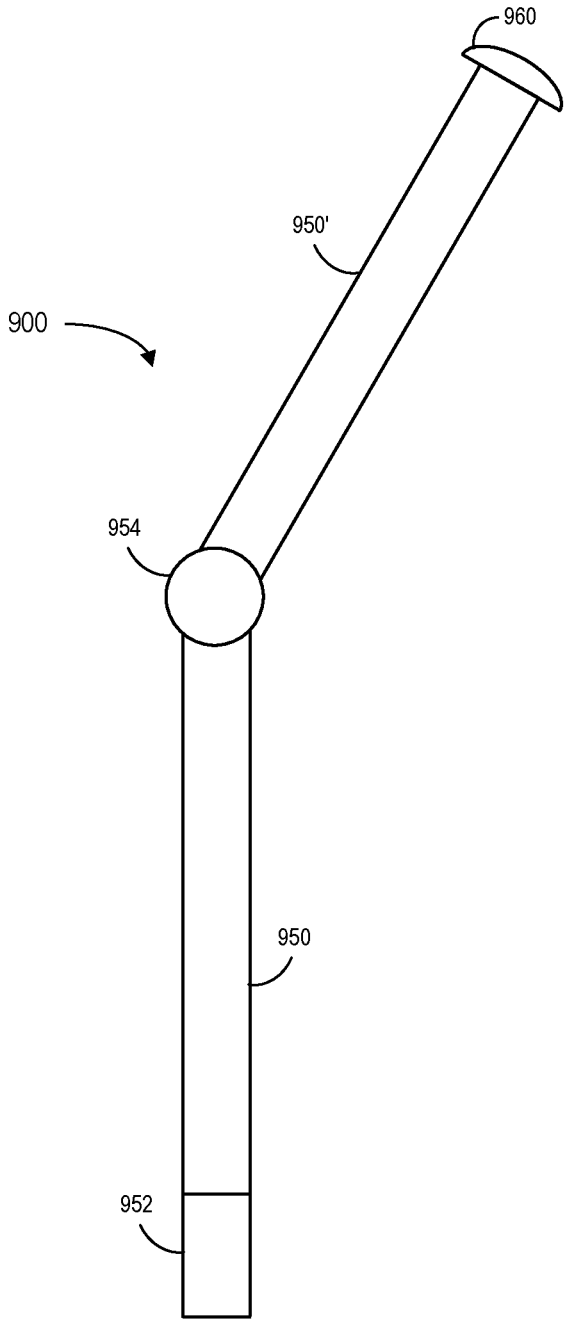
FIG. 9 is a hinged or pivoting system in accordance with some embodiments of the invention.

As another example, FIG. 9 is a hinged or pivoting system 900 in accordance with some embodiments of the invention. In this system 900, the extendable sensor mount 950 includes a mounting portion 952 opposite a sensor 960. Moreover, a hinge or pivot portion 954 may be provided to let a second portion of the body 950' be rotated with respect to the light bulb. Note that multiple hinge or pivot portions 954 might be incorporated, and/or embodiments might additionally utilize at least one telescoping portion as described with respect to FIG. 8.

Figure 10:
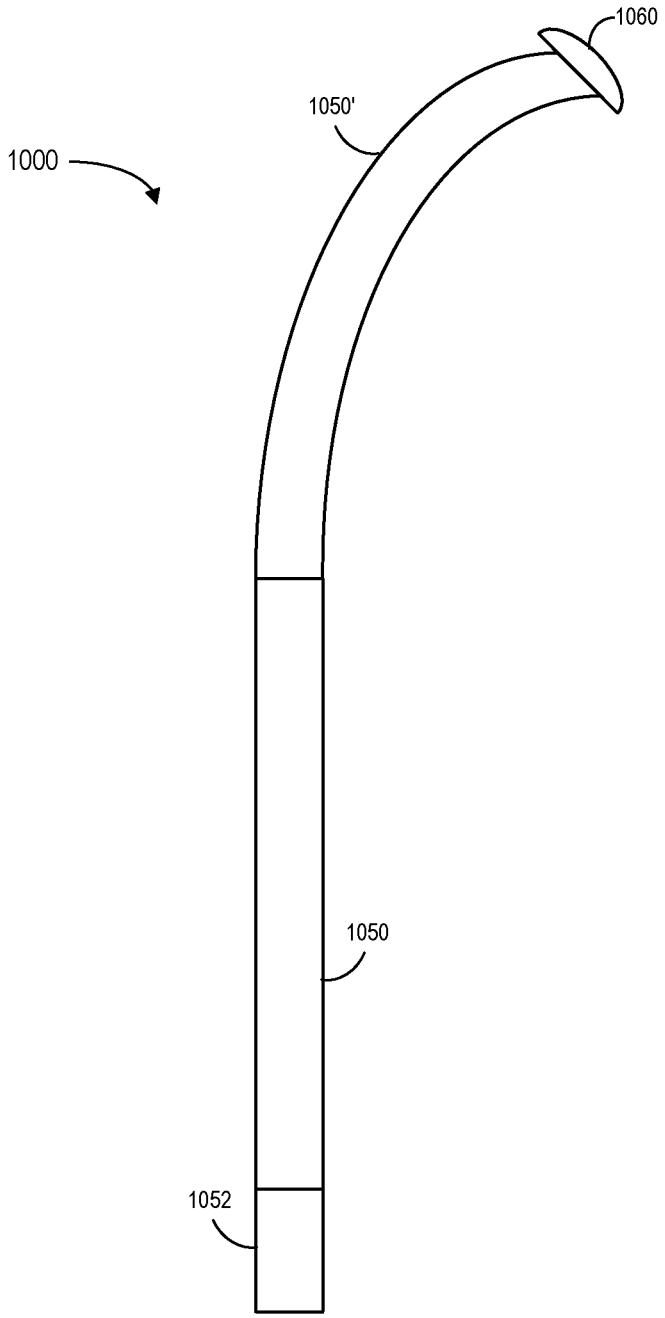
FIG. 10 is a flexible system in accordance with some embodiments of the invention.

As still another example, FIG. 10 is a flexible system 1000 in accordance with some embodiments of the invention. In this system 1000, the extendable sensor mount 1050 includes a mounting portion 1052 opposite a sensor 1060. In this example, a second portion of the body 1050' may be bendable or otherwise be able to be flexed into various shapes (and maintain those shapes). According to some embodiments, the entire extendable sensor mount 1050 may be formed of such a flexible material. Moreover, some embodiments might additionally utilize a hinge or pivot portion as described with respect to FIG. 9 and/or at least one telescoping portion as described with respect to FIG. 8.

Figure 11:
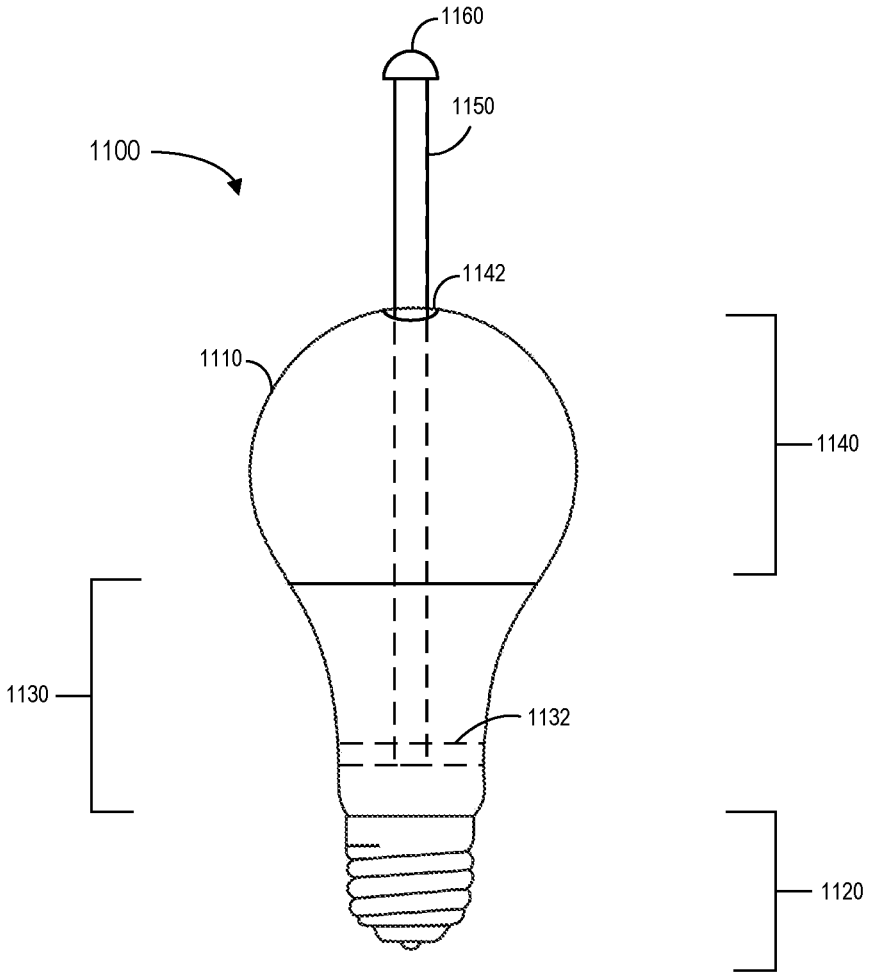
FIG. 11 is a system with a modified mount in accordance with some embodiments of the invention.

Note that an extendable sensor mount could be affixed to a light bulb in any of a number of different ways. For example, FIG. 11 is a system 1100 with a modified mount in accordance with some embodiments of the invention. As before, an extendable sensor mount 1150 (with a removable sensor 1160) has been inserted into a light bulb 1110 in accordance with some embodiments of the invention. The light bulb 1110 includes a base 1120 (to receive power), a body 1130, and a cover 1140 with an opening 1142. In this example, the lower portion of the body 1130 includes a receiving portion 1132 to mate with the first end of the extendable sensor mount 1150. The receiving portion 1132 might be, for example, an anchor attached to the body 1130 of the light bulb 1110 (e.g., have a "+" shaped profile). Note that the first end of the extendable sensor mount 1150 might instead attach to the base 1120 or cover 1140 of the light bulb 1110.

Figure 12A:
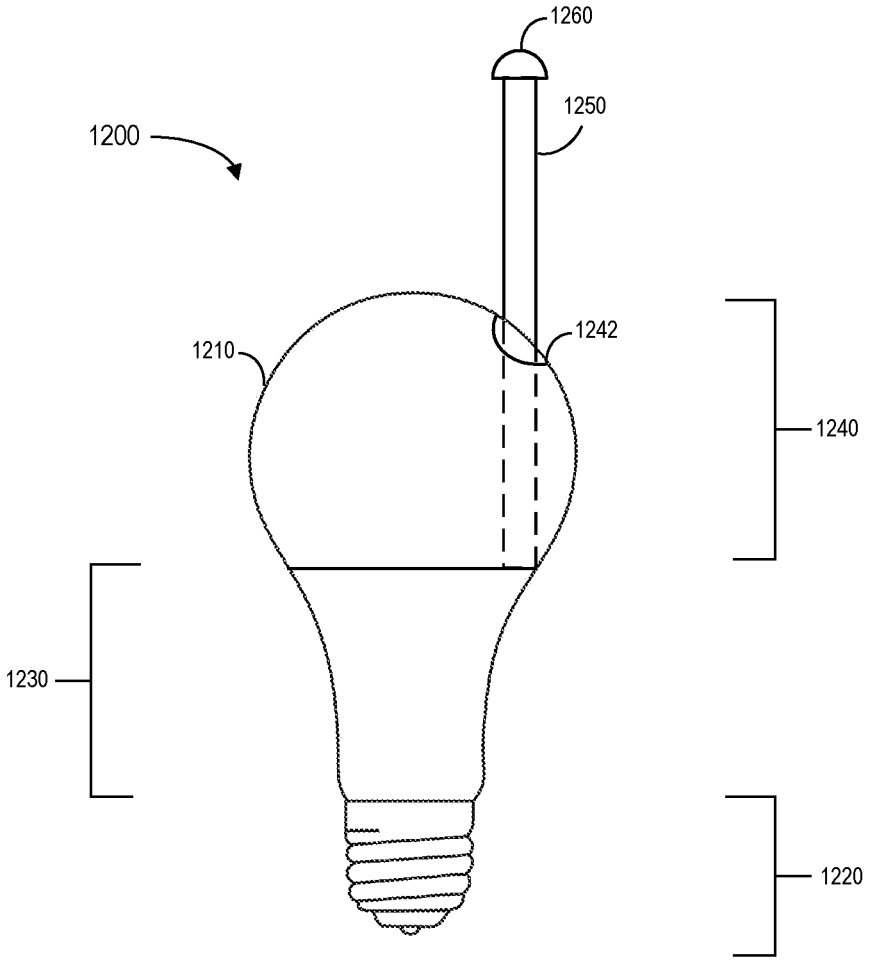
FIG. 12A is an off-center system in accordance with some embodiments of the invention.

Although the opening 1142 in the cover 1140 of the light bulb 1110 is illustrated as being at or near the center of the light bulb 1110, note that any of the embodiments may incorporate other designs. For example, FIG. 12A is an off-center system 1200 in accordance with some embodiments of the invention. As before, an extendable sensor mount 1250 (with a removable sensor 1260) has been inserted into a light bulb 1210 in accordance with some embodiments of the invention. The light bulb 1210 includes a base 1220 (to receive power), a body 1230, and a cover 1240 with an opening 1242. In this example, the opening 1242 is located to a side of the cover 1240 (and not the center of the cover 1240). Note that in some embodiments, multiple openings 1242 might be provide at various locations of the cover 1240, body 1230, and/or base 1220 of the light bulb 1210.

Figure 12D:
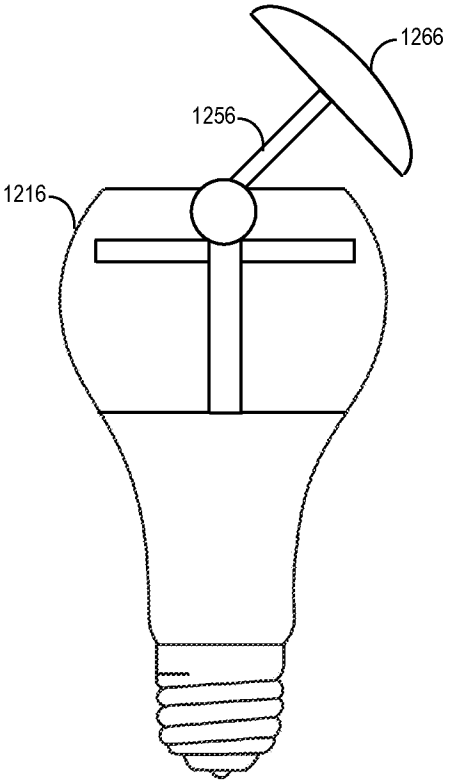
FIGS. 12B through 12D are some examples of light bulbs in accordance with various illustrative embodiments of the invention.
Figure 12C:
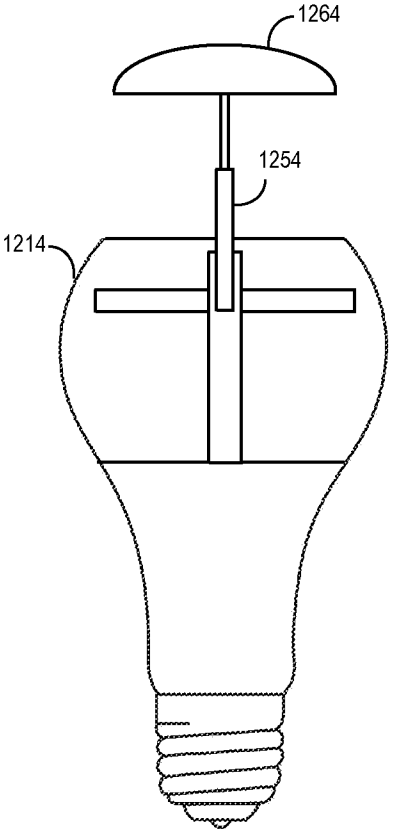
Figure 12B:
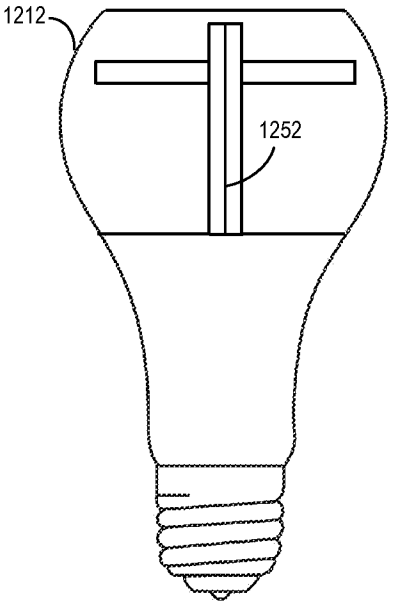

FIGS. 12B through 12D are some examples of light bulbs in accordance with various illustrative embodiments of the invention. In particular, FIG. 12B illustrates a light bulb 1212 having a wire 1252 running from a powered portion of the bulb up a mast to a receiving portion adapted to receive an adjustable sensor mount. In this way, sensor may utilize power from the light bulb 1212 and avoid the need to incorporate a battery. FIG. 12C illustrates such a light bulb 1214 after the adjustable sensor mount 1254 has been screwed into or otherwise affixed to the mast. In this example, the adjustable sensor casing 1254 can telescope to move a sensor casing 1264 toward and away from the bulb 1214. Note the sensor casing 1264 might hold multiple sensors and may, according to some embodiments, be shaped to simulate an overall bulb-shaped appearance when placed next to the bulb 1214. FIG. 12D illustrates a light bulb 1216 wherein the adjustable sensor mount 1256 is affixed to the bulb 1216 via a ball-bearing type connection. In this way, the sensor casing 1266 may be able to pivot and/or rotate in an number of directions as appropriate.

Figure 13:
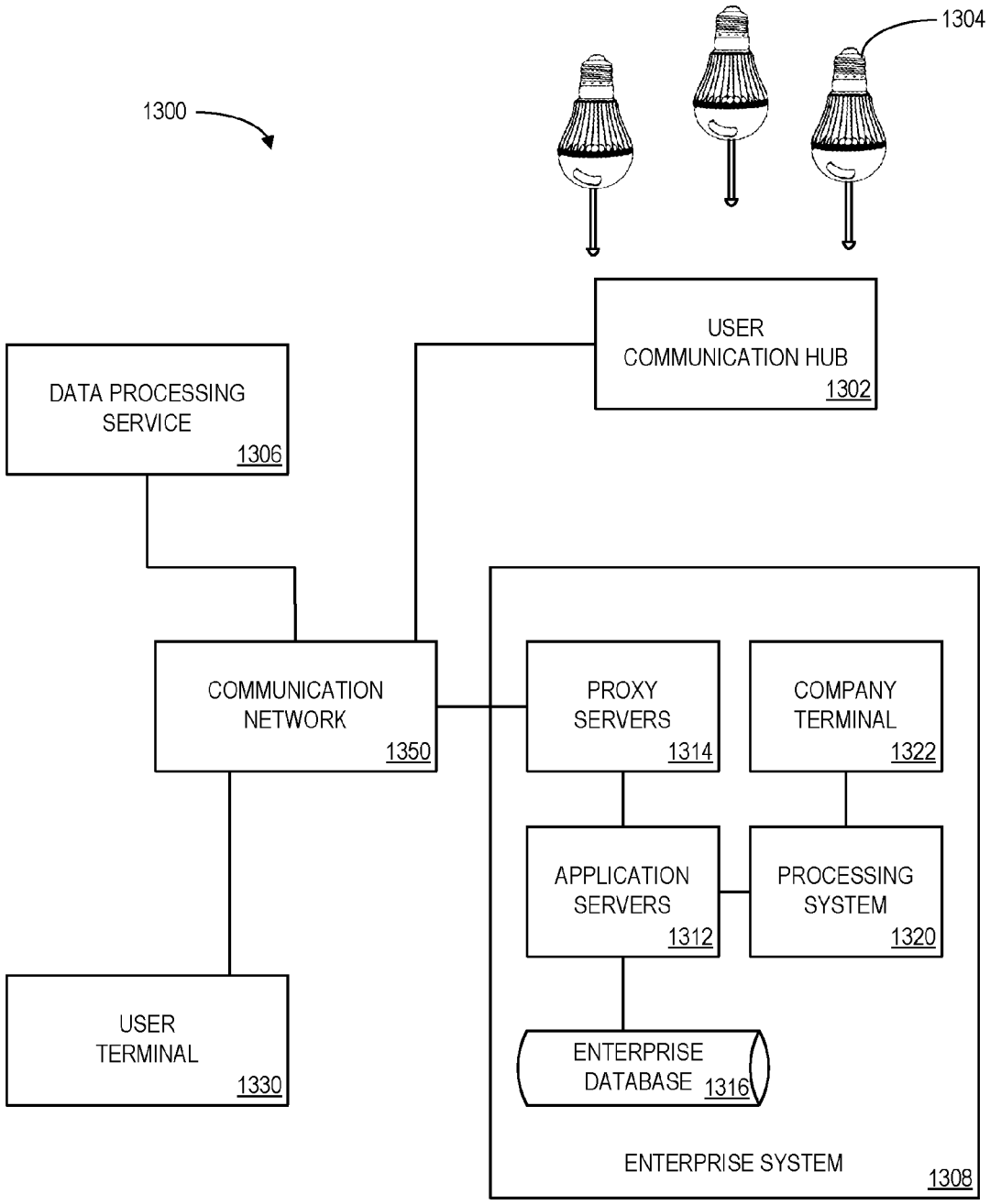
FIG. 13 is an architectural model of a system to facilitate the use of light fixtures according to an illustrative embodiment of the invention.

Light bulbs with extendable sensor mounts may thus be used to facilitate the collection and transmission of information associated with a residence. FIG. 13 is an architectural model of a system 1300 to facilitate use of "light fixtures" 1304 (some or all of which may have extendable sensor mounts) according to an illustrative embodiment of the invention. According to some embodiments, the light fixtures 1304 comprise energy efficient light fixtures, and, as used herein, the term "energy efficient light fixtures" might refer to, for example, an LED light fixture or any other type or source of illumination. The system 1300 may, in some embodiments, collect user information and/or energy consumption data associated with operation of the energy efficient light fixtures 1304.

According to some embodiments, the system includes a user communication hub 1302 that controls certain lighting characteristics of the light fixtures 1304 and/receives information for sensors incorporated with the light fixtures 1304. The user communication hub 1302 may, for example, store information about a user and, based on the user information and one or more protection features, collect and monitor information from the light fixtures 1304 (e.g., to determine if a child is within an appropriate pre-define area).

According to some embodiments, the user communication hub 1302 collects data about the light fixtures 1304. Together, the user communication hub 1302 and light fixtures 1304 may comprise a network remote from an enterprise. Note that the light fixtures 1304 might communicate with the communication hub 1302 in any number of ways including wirelessly, via power lines, etc. The user communication hub 1302 may be positioned inside a user's home, attached to the outside of the home, and/or be integrated into one or more light fixtures. As used herein, the term "home" might refer to any type of dwelling, including a standalone house, an apartment building, a co-op unit, etc. The user communication hub 1302 may be in communication with an enterprise system 1308 over a communication network 1350. The light fixtures 1304 and/or the user communication hub 1302 may communicate with the enterprise system 1308 though a wireless network such as a cellular network or using a wireless Internet connection. In general, the user communication hub 1302 can be any computing device or plurality of computing devices in cooperation having a data collection sensor (e.g., an antenna), a processor, a memory, and a means for transmitting the collected data. The light fixtures 1304 may wirelessly transmit information about user behaviors (e.g., when the fixtures 1304 are turned on or are in standby mode) and/or an amount of actual energy usage. In one implementation, the user communication hub 1302 is also configured to process the collected data. In some embodiments, the user communication hub 1302 or other elements of the system 1300 protect a user's privacy by encrypting the data, removing personal information, producing summary information, and/or taking other measures to reduce the likelihood that sensitive information is received by the enterprise or third parties.

In some embodiments, rather than sending collected data directly to the enterprise system 1308, the user communication hub 1302 sends collected data to a data processing service 1306, which processes the data to determine a result that is then sent to the enterprise system 1308. This can help protect a user's privacy, since the enterprise does not get detailed data about a user's behavior, but instead only receives summary information. Using a data processing service 1306 is in some implementations also preferable to having the user communication hub 1302 process data and execute sensor network features because it reduces the processing power needed by user communication hub 1302 and because using a third party data processing service 1306 may also make it more difficult for users to tamper with the data. The data processing service 1306 can perform additional monitoring functions, such as functions associated with other types of sensors (e.g., smoke detectors). Note that an enterprise might receive detailed reports from the third party data processing service 1306, summary reports (with certain details removed), and/or supplemented information (e.g., including information from one or more public databases). According to some embodiments, a user may access data via a user terminal 1330 (e.g., the user might view available protection features via a web page). Note that in some embodiments, a detailed record might be created recording all of the information associated with a large number of communication hubs 1302, including the status of light fixtures, the number of people in various rooms, the movement of people between rooms, etc. According to some embodiments summaries of this large store of information may be generated (e.g., on a ZIP code level).

According to some embodiments, an enterprise may use energy consumption data to allocate a savings amount between a user and the enterprise. With a sufficient amount of data, the enterprise can calculate a predicted amount of usage or savings for the user based on, for example, the user's habits. The enterprise can use the savings amount for setting or adjusting a discount value to be applied to the user. In some implementations, a score or discount is determined by the enterprise and/or a third party data processing service. In addition, the score or discount may be set by an automated process, which may be executed by the enterprise or otherwise affiliated with or in a third party arrangement with the enterprise. According to any embodiments described herein, a score might be used to determine a rebate, an energy company utility bill adjustment, and/or any other benefit that may be associated with a user.

According to some embodiments, such as the one illustrated in FIG. 13, the enterprise system 1308 includes a plurality of application servers 1312, a plurality of load balancing proxy servers 1314, an enterprise database 1316, a processing system 1320, and a company terminal 1322. These computing devices are connected by a local area network. Note that embodiments might be implemented using any other arrangement of computing devices, including a mesh of light fixtures, cloud storage, wide area networks, and/or a set of sensors that transmit information over one or more networks.

The application servers 1312 are responsible for interacting with the user communication hub 1302 and/or the data processing service 1306. The data exchanged between the enterprise system 1308 and user communication hub 1302 and/or data processing service 1306 can utilize push and pull technologies where the application servers 1312 of the enterprise system 1308 can act as both a server and client for pushing data to the data processing service 1306 (e.g., which light fixtures 1304 to control, when to stop data collection, rules for monitoring services requested by the user) and for pulling data from the data processing service 1306. The application servers 1312 or other servers of the enterprise system 1308 can request to receive periodic data feeds from the user communication hub 1302 and/or data processing service 1306. The communication between the application servers 1312 and the data processing service 1306 can follow various known communication protocols, such as TCP/IP. Alternatively, the application servers 1312 and data processing service 1306 can communicate with each other wirelessly, e.g., via cellular communication, Wi-Fi, Wi-Max, or other wireless communications technologies or combination of wired or wireless channels. The load balancing proxy servers 1314 operate to distribute the load among application servers 1312.

The enterprise database 1316 might store information about user behaviors, safety data, security data, health data, etc. For each user, the database 1316 might include for example and without limitation, the following data fields: an identifier, a user subsidy amount, a date of purchase, dates of subsequent renewals, product and price of product sold, applicable automation services (for example, electronic billing, automatic electronic funds transfers, centralized user service plan selections, etc.), user information, user payment history, protection feature selections, user demographic and/or health information, sensor information (e.g., including a sensor type, extendable sensor mount information, etc.) or derivations thereof.

The processing system 1320 is configured for facilitating use of protection features and/or allocating an energy savings amount between a user and the enterprise. The processing system 1320 may comprise multiple separate processors, such as a protection feature processor, which may generate electronic warning messages from raw or processed data from the user communication hub 1302 or data processing service 1306 over the communications network 1350; and/or a business logic processor, which determines an appropriate savings amount for a user. An exemplary implementation of a computing device for use in the processing system 1320 is discussed in greater detail in relation to FIG. 14.

The company terminals 1322 provide various user interfaces to enterprise employees to interact with the processing system 1320. The interfaces include, without limitation, interfaces to input and adjust protection features; review energy usage data and/or scores; to retrieve data related to user contracts; and/or to manually adjust an allocation amount. In some instances, different users may be given different access privileges. For example, marketing employees may only be able to retrieve information about users but not make any changes to data. Such interfaces may be integrated into one or more websites for managing the enterprise system 1308 presented by the application servers 1312, or they may be integrated into thin or thick software clients or stand-alone software. The company terminals 1322 can be any computing devices suitable for carrying out the processes described above, including personal computers, laptop computers, tablet computers, smartphones, servers, and other computing devices.

The user terminal 1330 provides various user interfaces to users to interact with the enterprise system 1308 over the communications network 1350. Potential users can access user terminals 1330 to input user information, select protection features, and/or retrieve contract and pricing information for subsidies offered by the enterprise. Users can enter information pertaining to energy usage and/or changes in their contract, e.g., an addition or subtraction of user lighting fixtures 1304 and stand-alone sensors, etc.

In some embodiments, the user communication hub 1302 may not be continually connected to the enterprise system 1308 via the network 1350. For example, the user communication hub 1302 may be configured to temporarily store data if the user communication hub 1302 becomes disconnected from the network 1350. When the connection is restored, the user communication hub 1302 can then transmit the temporarily stored data to the enterprise system 1308. The user communication hub 1302 may alternatively be configured to connect to the communications network 1350 through a user's home Wi-Fi network. In this case, the user communication hub 1302 stores energy usage data until a pre-determined time, connects to the user's wireless network, and sends the data. In some embodiments, the user communications hub 1302 is not connected to the network 1350 at all, but rather, data collected is transmitted to the enterprise through other means. For example, a user can receive a user communication hub 1302 from the enterprise, couple the device 1304 to his or her light fixtures 1304, and then either mail the device 1304 with the collected data to the enterprise system 1308 or extract and send the collected data to the enterprise system 1308 via mail, email, or through a website.

Thus, in some embodiments, the communication hub 1302 may facilitate the collection and exchange of information associated with the system 1300. In other embodiments, the light fixtures 1304 themselves may form a computer "mesh network." As used herein, the phrase "mesh network" may refer to a network topology having a decentralized design in which each node on the network may connects to multiple other nodes. Moreover, some of the network nodes may "talk" directly to each other without requiring the assistance of an Internet connection (helping reduce the chance of a single point of failure). If one node can no longer operate, the remaining nodes may still communicate with each other, directly or through one or more intermediate nodes. Note that a mesh network might use a full mesh topology or a partial mesh topology. Also note that one or more of the nodes may be selected as a "master node" (which can be replaced, such as when the master node fails for any reason). Further note that any of the embodiments described herein might be implemented utilizing cloud computing. For example the hub or master node might upload data to the cloud and receive instructions back from an application executing within the cloud (and use those instructions, for example, to facilitate control of the lighting fixtures 1304).

Although the element described with respect to FIG. 13 is a light fixture 1304, note that similar systems may be associated with other residential appliances that may be located at and/or service the residence (e.g., water, heating, and/or cooling fixtures). Further, in addition to, or instead of, the light fixtures, a set of other sensors might collect and/or transmit information about the home environment. In some embodiments, a set of sensors (including light fixtures 1304 with sensors and/or other types of stand-alone sensors) might create an ecosystem that may be monitored and used to made adjustments to the home environment and/or provide protection features. For example, a wearable device (e.g., that measures a person's heartbeat), a bed mattress pad (e.g., that measures the quality of a person's sleep), and/or a thermostat might form a circuit of monitoring devices to feed data through a network that may be used to control and/or adjust lighting characteristics and/or other features of the home environment (e.g., by reducing the temperature in a bedroom by a personalized amount when a particular person goes to bed). Moreover, some embodiments might be associated with one or more devices outside the home environment, such as device in a vehicle, including an automobile, a boat, a snowmobile, and/or an airplane.

Figure 14:
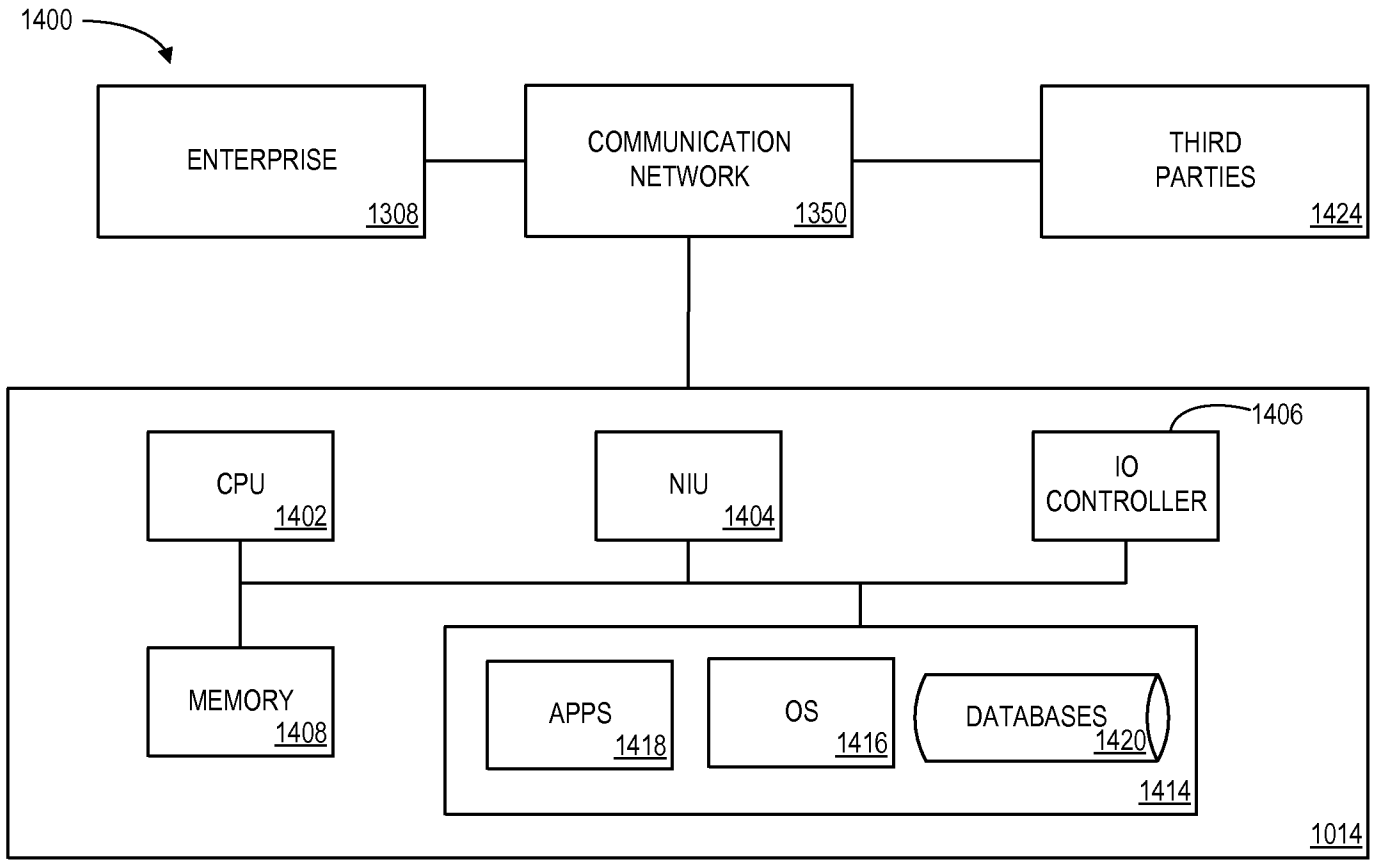
FIG. 14 is a block diagram of a computing system that may be associated with FIG. 1 according to an illustrative embodiment of the invention.

FIG. 14 is a block diagram of a computing device 1400 that may be associated with the system 1300 of FIG. 13 according to an illustrative embodiment of the invention. The computing device 1400 comprises at least one Network Interface Unit ("NIU") 1404, an Input Output ("IO") controller 1406, a memory 1408, and one or more data storage devices 1414. The memory 1408 may include at least one Random Access Memory ("RAM") and at least one Read-Only Memory ("ROM"). All of these elements are in communication with a Central Processing system ("CPU") 1402 to facilitate the operation of the computing device 1400. The computing device 1400 may be configured in many different ways. For example, the computing device 1400 may be a conventional standalone computer or alternatively, the functions of computing device 1400 may be distributed across multiple computer systems and architectures. The computing device 1400 may be configured to perform some or all of the sensor network feature processing, or these functions may be distributed across multiple computer systems and architectures. In the embodiment shown in FIG. 14, the computing device 1400 is linked, via network 1350 or a local network, to other servers or systems housed by the enterprise system 1308, such as the load balancing server and/or the application servers of FIG. 13.

The computing device 1400 may be configured in a distributed architecture, wherein databases and processors are housed in separate units or locations. The computing device 1400 may also be implemented as a server located either on site near the enterprise system 1308, or it may be accessed remotely by the enterprise system 1308. Some such units perform primary processing functions and contain at a minimum a general controller or the CPU 1402 and the memory 1408. In such an embodiment, each of these units is attached via the NIU 1404 to a communications hub or port (not shown) that serves as a primary communication link with other servers, client or user computers and other related devices. The communications hub or port may have minimal processing capability itself, serving primarily as a communications router. A variety of communications protocols may be part of the system, including, but not limited to: Ethernet, SAP, SAS™, ATP, BLUETOOTH™, GSM and TCP/IP. Note that embodiments described herein may communicate via any type of communication network, including, for example, a Personal Area Network ("PAN"), a Wireless PAN ("WPAN"), a Local Area Network ("LAN"), a Wide Area Network ("WAN"), a Near Field Communication ("NFC") network, a Body Area Network ("BAN"), and/or the internet. Moreover, as used herein the term BLUETOOTH™ may refer to, for example, BLUETOOTH™ Low Energy ("BLE") and/or BLUETOOTH™ Smart, low energy, and/or battery powered technologies.

The CPU 1402 might comprise a processor, such as one or more conventional microprocessors and one or more supplementary co-processors such as math co-processors for offloading workload from the CPU 1402. The CPU 1402 is in communication with the NIU 1404 and the IO controller 1406, through which the CPU 1402 communicates with other devices such as other servers, user terminals, or devices. The network NIU 1404 and/or the IO controller 1406 may include multiple communication channels for simultaneous communication with, for example, other processors, servers or client terminals. Devices in communication with each other need not be continually transmitting to each other. On the contrary, such devices need only transmit to each other as necessary, may actually refrain from exchanging data most of the time, and may require several steps to be performed to establish a communication link between the devices.

The CPU 1402 is also in communication with the data storage device 1414. The data storage device 1414 may comprise an appropriate combination of magnetic, optical and/or semiconductor memory, and may include, for example, RAM, ROM, flash drive, an optical disc such as a compact disc and/or a hard disk or drive. The CPU 1402 and the data storage device 1414 each may be, for example, located entirely within a single computer or other computing device; or connected to each other by a communication medium, such as a USB port, serial port cable, a coaxial cable, an Ethernet type cable, a telephone line, a radio frequency transceiver or other similar wireless or wired medium or combination of the foregoing. For example, the CPU 1402 may be connected to the data storage device 1414 via the network interface unit 1404.

The CPU 1402 may be configured to perform one or more particular processing functions. For example, the computing device 1400 may be configured to perform protection feature processing for multiple light fixtures. The same computing device 1400 or another similar computing device may be configured multiple networks associated with one or more houses and users. The same computing device 1400 or another similar computing device may be configured for calculating an energy bill discount for a residence or user based on these factors.

The data storage device 1414 may store, for example, (i) an operating system 1416 for the computing device 1400; (ii) one or more applications 1418 (e.g., computer program code and/or a computer program product) adapted to direct the CPU 1402 in accordance with the present invention, and particularly in accordance with the processes described in detail with regard to the CPU 1402; and/or (iii) database(s) 1420 adapted to store information that may be utilized to store information required by the program. The database(s) 1420 may including all or a subset of data stored in enterprise database 1316, described above with respect to FIG. 13, as well as additional data, such as formulas or manual adjustments, used in establishing protection algorithms, rules, adjustments, etc.

The operating system 1416 and/or applications 1418 may be stored, for example, in a compressed, an uncompiled and/or an encrypted format, and may include computer program code. The instructions of the program may be read into a main memory of the processor from a computer-readable medium other than the data storage device 1414, such as from the ROM 1412 or from the RAM 1410. While execution of sequences of instructions in the program causes the CPU 1402 to perform the process steps described herein, hard-wired circuitry may be used in place of, or in combination with, software instructions for implementation of the processes of the present invention. Thus, embodiments of the present invention are not limited to any specific combination of hardware and software.

Suitable computer program code may be provided for using a protection feature to receive information from light fixture sensors over a period of time. The program also may include program elements such as an operating system, a database management system and "device drivers" that allow the processor to interface with computer peripheral devices (e.g., a video display, a keyboard, a computer mouse, etc.) via the IO controller 1406.

The term "computer-readable medium" as used herein refers to any non-transitory medium that provides or participates in providing instructions to the processor of the computing device (or any other processor of a device described herein) for execution. Such a medium may take many forms, including but not limited to, non-volatile media and volatile media. Non-volatile media include, for example, optical, magnetic, or opto-magnetic disks, or integrated circuit memory, such as flash memory. Volatile media include Dynamic Random Access Memory ("DRAM"), which typically constitutes the main memory. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM or Electronically Erasable Programmable Read-Only Memory ("EEPROM"), a FLASH-EEPROM, any other memory chip or cartridge, or any other non-transitory medium from which a computer can read.

Various forms of computer readable media may be involved in carrying one or more sequences of one or more instructions to the CPU 1402 (or any other processor of a device described herein) for execution. For example, the instructions may initially be borne on a magnetic disk of a remote computer (not shown). The remote computer can load the instructions into its dynamic memory and send the instructions over an Ethernet connection, cable line, or even telephone line using a modem. A communications device local to a computing device (e.g., a server) can receive the data on the respective communications line and place the data on a system bus for the processor. The system bus carries the data to main memory, from which the processor retrieves and executes the instructions. The instructions received by main memory may optionally be stored in memory either before or after execution by the processor. In addition, instructions may be received via a communication port as electrical, electromagnetic or optical signals, which are exemplary forms of wireless communications or data streams that carry various types of information.

Figure 15:
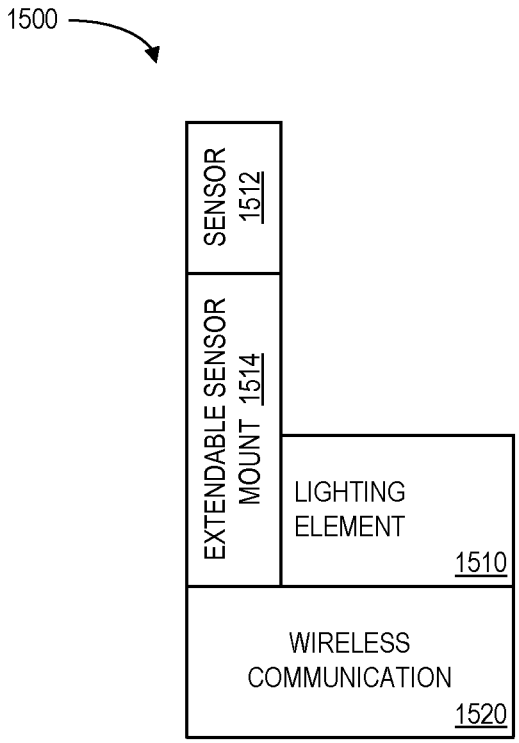
FIG. 15 is a block diagram of a light element and a device coupled to the lighting for providing data, according to an illustrative embodiment of the invention.

FIG. 15 is a block diagram of a light fixture 1500 having a lighting element 1510 and a wireless communication portion 1520. The lighting element 1510 might be associated with an LED unit or any other type energy efficient source of illumination. The wireless communication portion 1520 may be co-located and/or located within the lighting element 1510. According to some embodiments, the wireless communication portion 1520 receives data via a household electrical system and/or to the user communication hub 1302 though a wireless connection, e.g., BLUETOOTH or Wi-Fi (e.g., and the received data may be used to control a lighting characteristic of the lighting element 1510). Data obtained by the user communication hub 1302 from the light fixture 1500 may also be reported to the enterprise. In some embodiments, the wireless portion 1520 turns on automatically when the light fixture 1500 is turned on; moreover, the wireless communication portion 1520 may be powered by the light fixture 1500. As illustrated in FIG. 15, a sensor portion 1512 of the light fixture 1500 may be attached via an extendable sensor mount 1514, collect information, and transmit the information via the wireless communication portion 1520.

Figure 16:
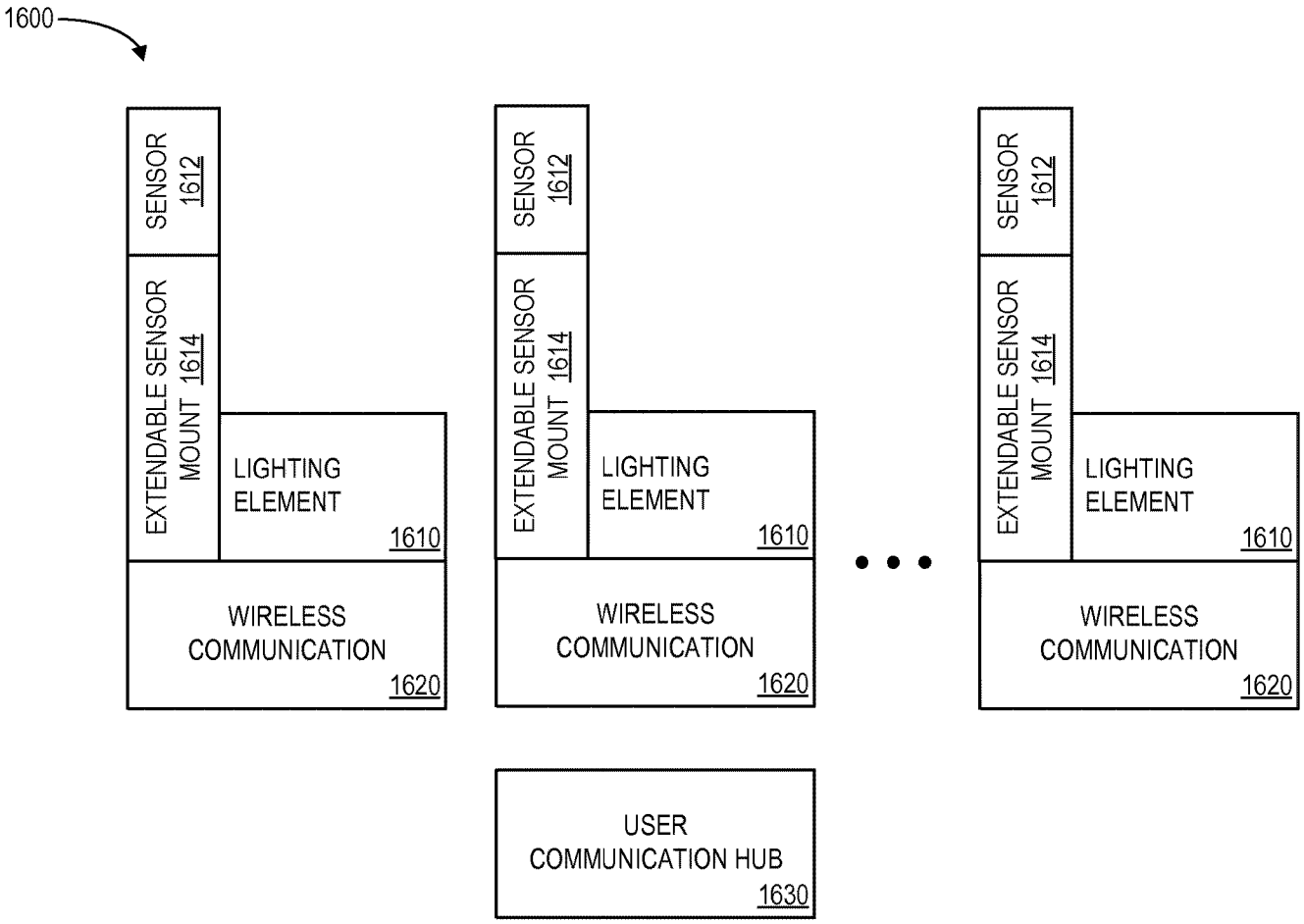
FIG. 16 illustrates a light fixture network in accordance with some embodiment of the invention.

FIG. 16 is a block diagram of a network 1600 having a number of light fixtures (each with a lighting element 1610 and a wireless communication portion 1620). The light elements 1610 might be associated with an LED unit or any other type energy efficient source of illumination. The wireless communication portions 1620 may be co-located and/or located within the lighting elements 1610. According to some embodiments, all of the wireless communication portions 1620 transmit data to a user communication hub 1630 though a wireless connection, e.g., BLUETOOTH or Wi-Fi. The communication hub 1630 may use a protection feature to calculate a lighting parameter to be transmitted to the wireless communication portions 1620 as appropriate. Data obtained by the user communication hub 1630 from the light fixtures may also be reported to the enterprise. The user communication hub 1630 may also include a wireless communications device for sending collected data, including data indicative of energy consumption and scoring and receiving commands from the data processing service 106 and/or enterprise system 1308 via the network 1350 of FIG. 13. The user communication hub 1630 may also be configured for communication with the user or a resident via a user interface. The user interface might include output components, such as a screen or speakers, and input components, such as a touch screen, keyboard, or microphone. The user interface can facilitate entry of user information, selection of protection features, etc. As illustrated in FIG. 16, a sensor portion 1612 of at least some of the light fixtures may be attached via an extendable sensor mount 1614, collect information, and transmit the information via the wireless communication portions 1620.

Figure 17:
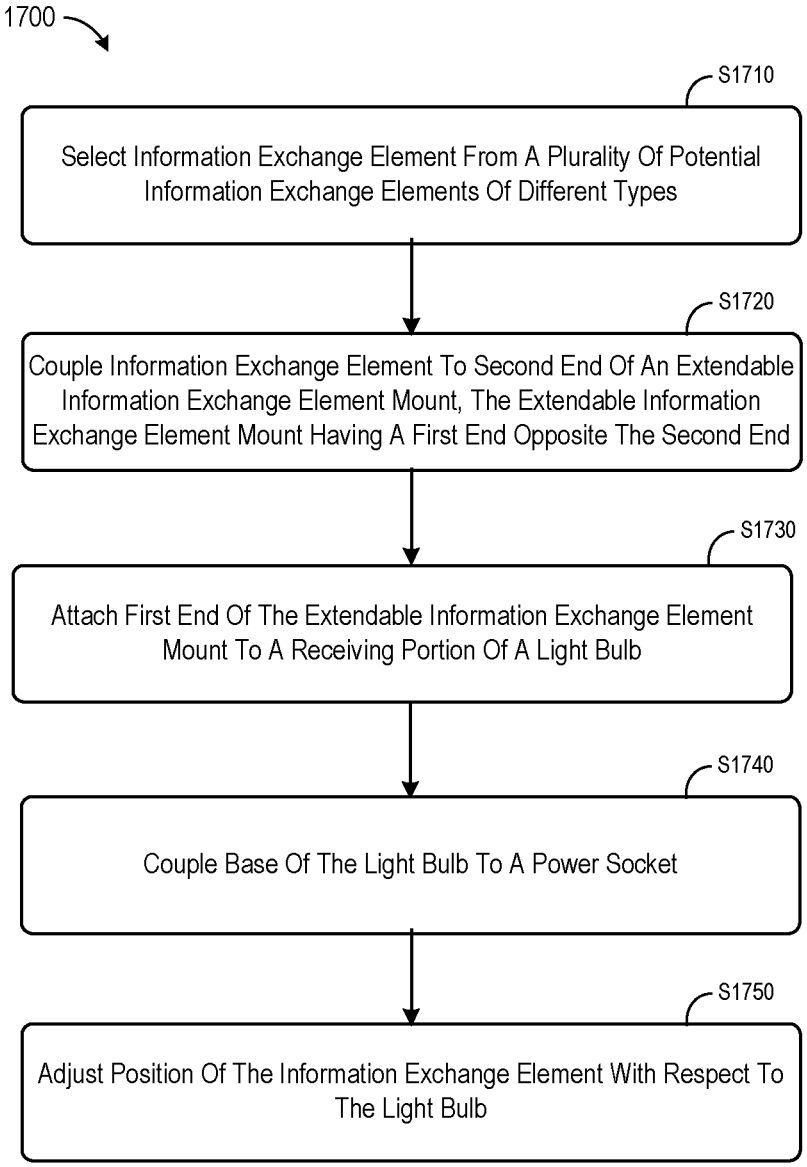
FIG. 17 is a flowchart of a method according to an illustrative embodiment of the invention.

FIG. 17 is a flowchart of a method 1700 in accordance with some embodiments. The method 1700 might be performed by an installer associated with the user communication hub 1302, the data processing service 1306, the enterprise system 1308, or any combination of these. At S1710, the installer may select an "information exchange element" from a plurality of potential information exchange elements of different types. As used herein, the phrase "information exchange element" might refer to a sensor. The phrase might also refer to, for example, an audio speaker, an image projector, and/or a wireless signal boosting, extending, or relaying device. At S 1720, the installer may couple the information exchange element to a second end of an extendable information exchange element mount, the extendable information exchange element mount having a first end opposite the second end. At S1730, the installer may attach the first end of the extendable information exchange element mount to a receiving portion of a light bulb. A base of the light bulb may be coupled to a power socket at S1740, and a position of the information exchange element may be adjusted with respect to the light bulb at S1750 (e.g., to avoid blockage by a lamp shade). Note that these steps might be performed in any order that is practical.

Figure 18:
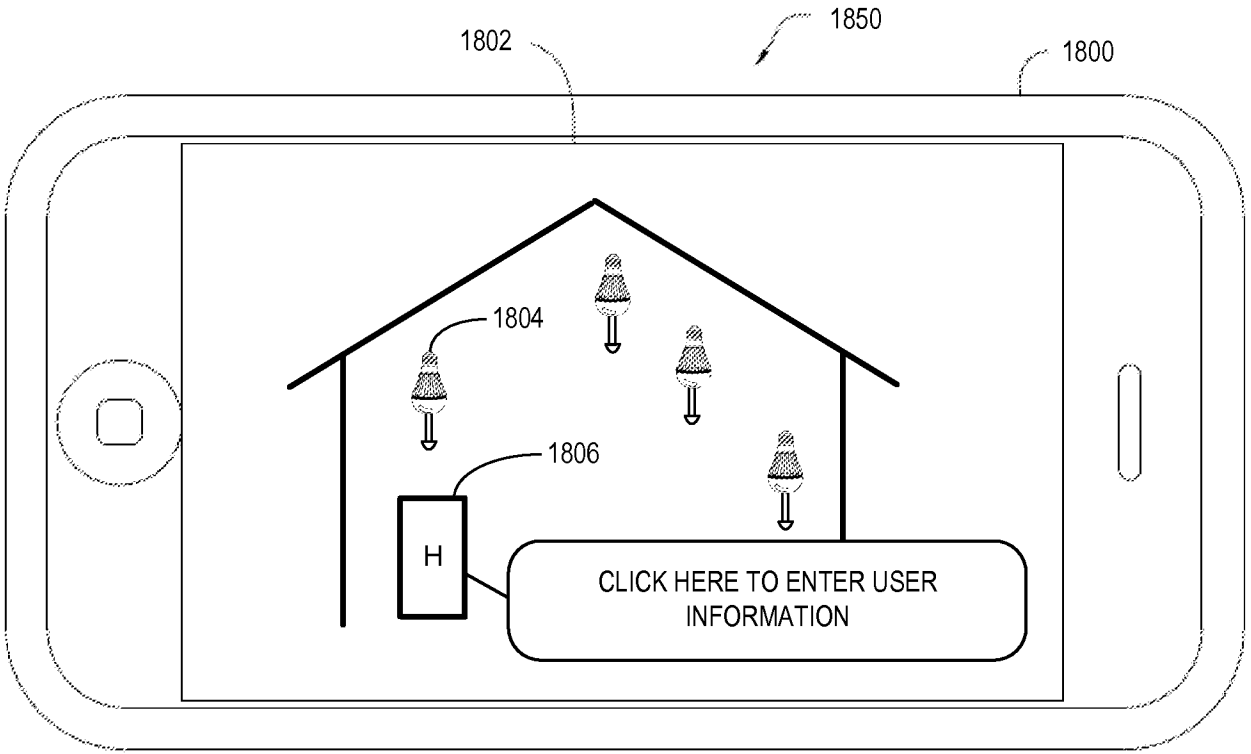
FIG. 18 illustrates a network display in accordance with some embodiments described herein.

According to some embodiments, information about a home light fixture network may be displayed to a user on a display. For example, referring now to FIG. 18, a diagram 1850 depicting a user interface 1802 is shown. The user interface 1802 may be displayed on device 1800 such as a mobile telephone, PDA, tablet computer, personal computer, or the like. For example, the device 1800 may be a PC, an iPhone® or smartwatch from Apple, Inc., a BlackBerry® from RIM, a mobile phone using the Google Android® operating system, or the like. The user interface 1802 depicts a portion of a user's home. The user interface 1802 may display locations of light fixtures 1804 (e.g., with extendable sensor mounts) and/or a communication hub "H" 1806. In this way, a user may be able to quickly view the status of his or her network. According to some embodiments, selecting the H icon 1806 results in a user being able to enter information about his or her preferences, select a home network feature, etc.

Figure 19:
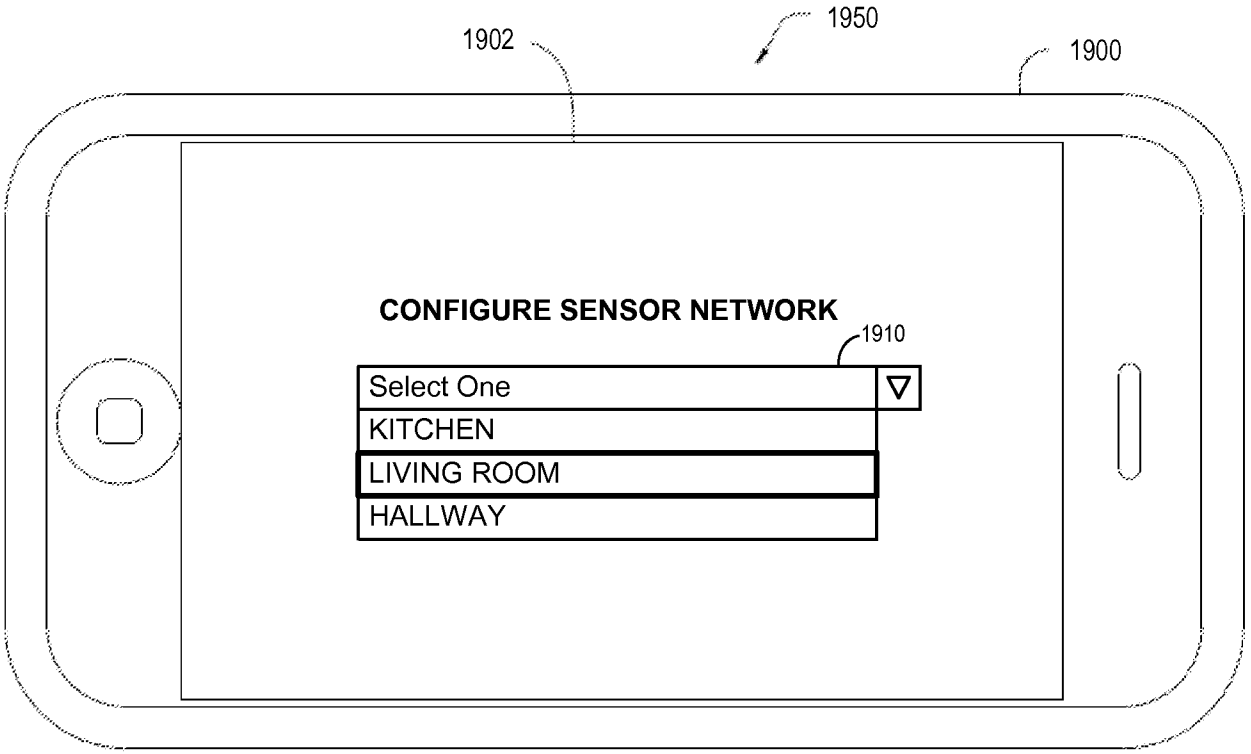
FIG. 19 illustrates a sensor network configuration display according to some embodiments.

For example, FIG. 19 is a diagram 1950 depicting a user interface 1902 displayed on a device 1900. The user interface 1902 includes a drop-down menu selection area 1910 that can be accessed by a user to select an appropriate portion of his or her house (e.g., to access information about the kitchen, the second floor, basement, etc.). The user might then be able to customize sensor network information and/or performance options when the appropriate portion of the sensor network has been selected.

Figure 20:
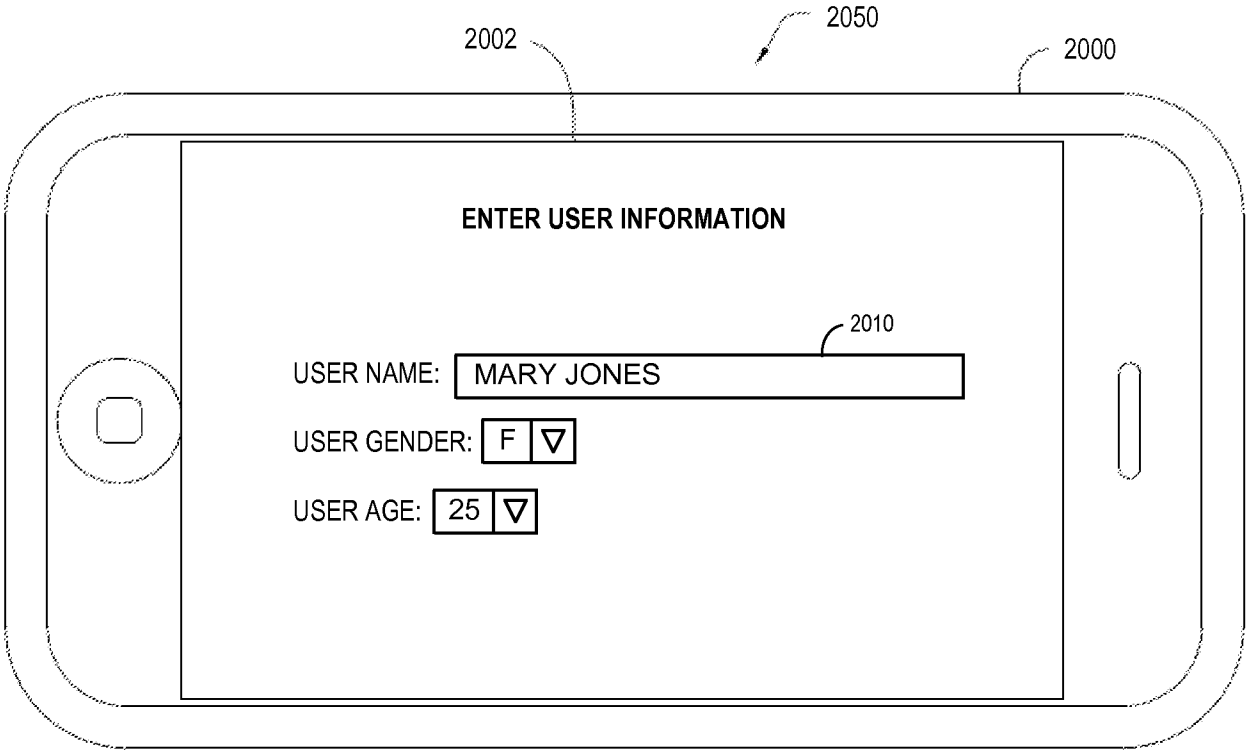
FIG. 20 illustrates a user information display according to some embodiments.

Information about one or more users may also be collected to facilitate the operation and use of the light fixtures. For example, FIG. 20 is a diagram 2050 depicting a user information interface 2002 displayed on a device 2000. The user information interface 2002 includes a data entry portion 2010 where a user may enter, for example, his or her name, gender, and age (or date of birth). This information may then be used to select an appropriate sensor network feature or adjust values associated with a selected sensor network feature. For example, very different nighttime safety zone perimeters might be appropriate for young children, teenagers, and/or the elderly.

Figure 21:
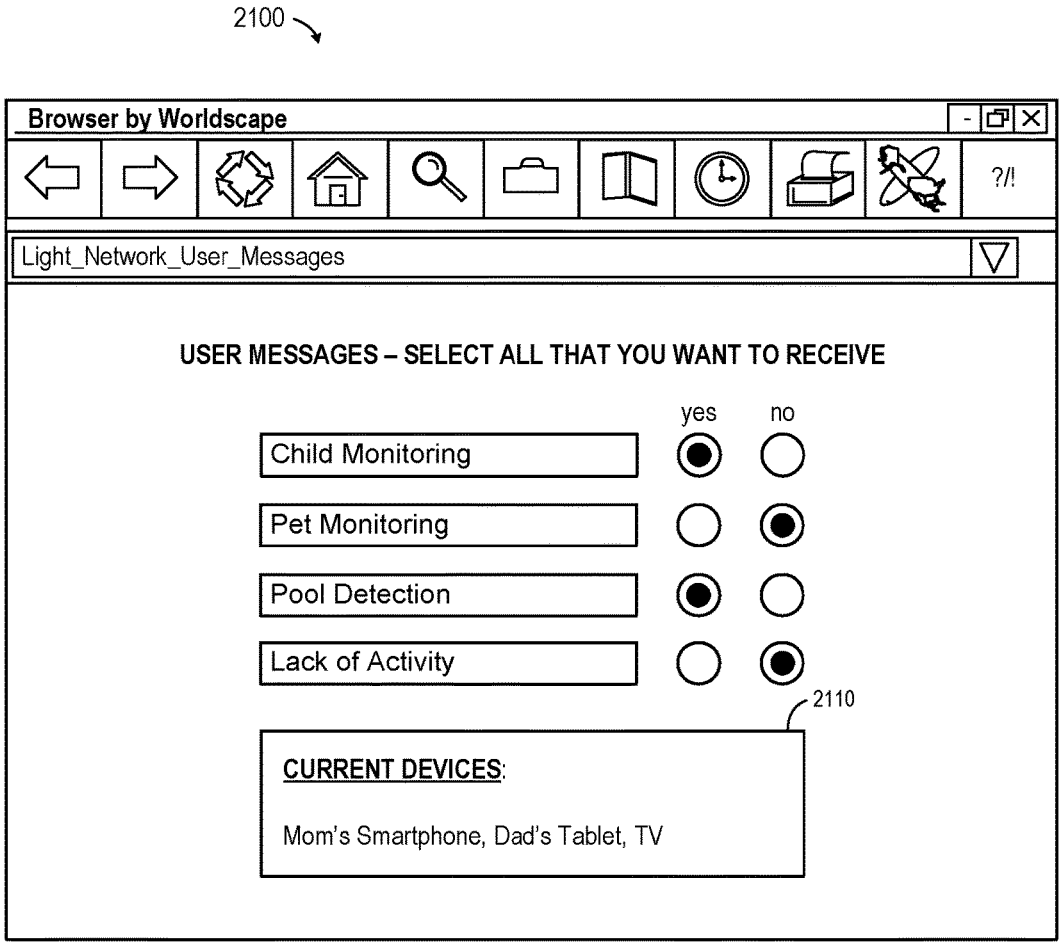
FIG. 21 illustrates a user message preference display in accordance with some embodiments.

Information about a user's message conditions may be defined for a sensor network. For example, FIG. 21 is web-based message condition display 2100 according to some embodiments. The message condition display 2100 includes a data entry portion where a user can indicate if he or she has wants to receive various types of message (e.g., air quality, child monitoring, pet monitoring, swimming pool detection, lack of activity messages, etc.). Based on this information, an appropriate message template may be selected for the user (or adjustments to values associated with a selected template may be made). According to some embodiments, some or all of these messages might be associated with information received from a user's wearable activity tracker (e.g., his or her current heartbeat), an electronic medical record, etc. Note that the features described herein are provided only as an example, and any other types of message might be used in connections with the embodiments described herein. For example, a user's sleep scorecard might be manually or automatically updated, a dietary history might be utilized, and/or a list of medications and/or supplements taken by a customer might be manually or automatically tracked. The message display 2100 also indicates which devices (associated with which users) are currently configured to receive and display these messages when appropriate.

Figure 22:
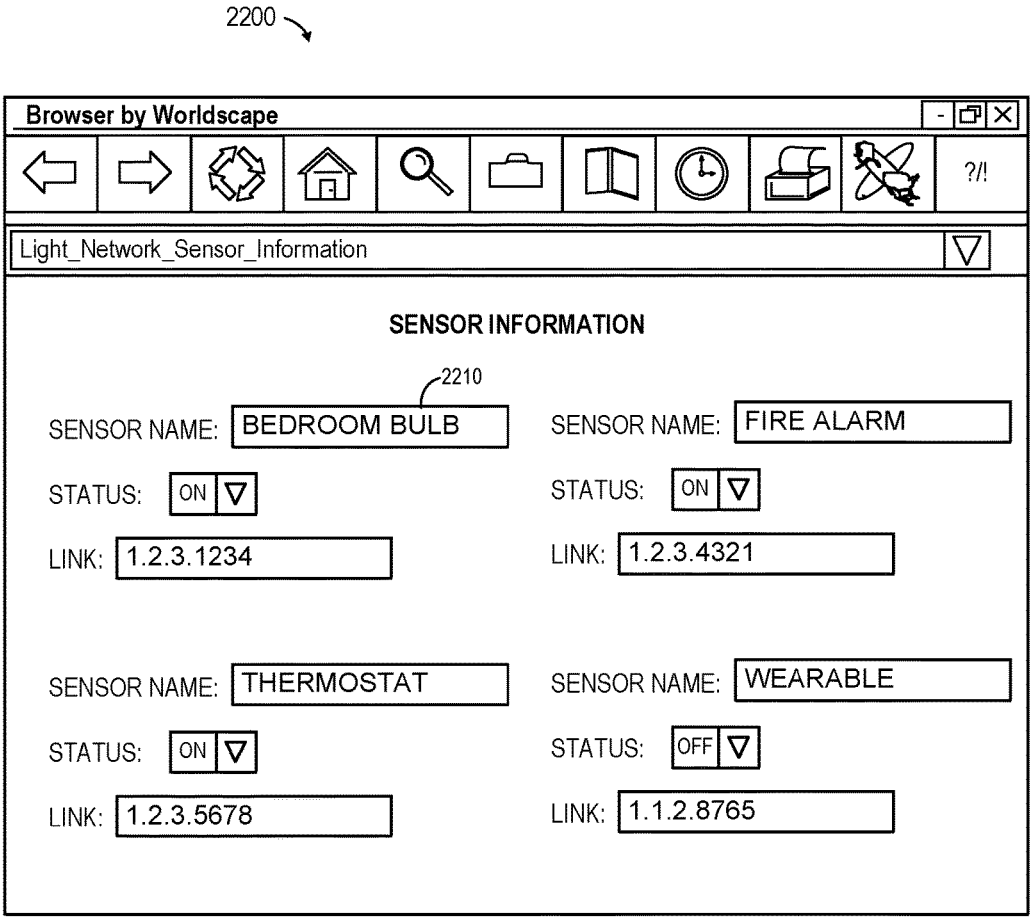
FIG. 22 illustrates a sensor configuration display according to some embodiments.

Sensor information may be used to select an appropriate network feature or to determine if a currently selected network feature is working as intended. For example, FIG. 22 illustrates a sensor information display 2200 according to some embodiments. The sensor information display 2200 includes a data entry area where a user can provide a sensor name, a sensor status (e.g., on, off, dim, standby, etc.), and link information (e.g., an IP address that can be used to receive information from and/or send information to the sensor). Examples of sensor devices include energy efficient light fixtures, extendable sensor mounts, thermostats, a fire alarm or other air quality sensor, movement detectors, wearable devices (e.g., a smartwatch), etc.

Figure 23:
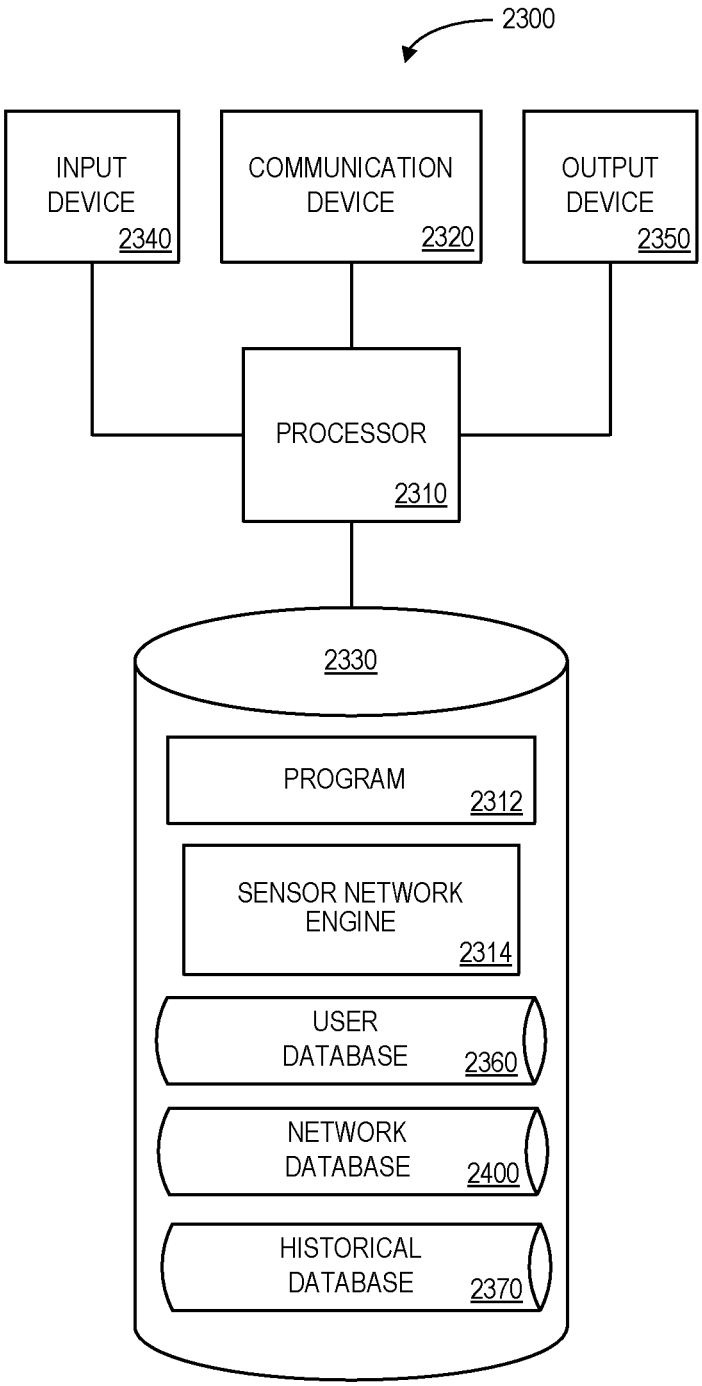
FIG. 23 is a block diagram of a sensor network platform provided in accordance with some embodiments.

The processes described herein may be performed by any suitable device or apparatus. FIG. 23 is one example of a sensor network platform 2300 according to some embodiments. The sensor network platform 2300 may be, for example, associated with the system 1300 of FIG. 13. The sensor network platform 2300 comprises a processor 2310, such as one or more commercially available CPUs in the form of one-chip microprocessors, coupled to a communication device 2320 configured to communicate via a communication network (not shown in FIG. 23). The communication device 2320 may be used to communicate, for example, with one or more remote light fixtures, user communication hubs, enterprises, and/or third party services. The sensor network platform 2300 further includes an input device 2340 (e.g., a mouse and/or keyboard to enter information about protection features) and an output device 2350 (e.g., a computer monitor to display reports and/or results to an administrator).

The processor 2310 also communicates with a storage device 2330. The storage device 2330 may comprise any appropriate information storage device, including combinations of magnetic storage devices (e.g., a hard disk drive), optical storage devices, and/or semiconductor memory devices. The storage device 2330 stores a program 2312 and/or a sensor network engine 2314 for controlling the processor 2310. The processor 2310 performs instructions of the programs 2312, 2314, and thereby operates in accordance with any of the embodiments described herein. For example, according to some embodiments, information may be received about at least one user associated with a light fixture network having a plurality of light fixtures each equipped with an extendable sensor mount and a wireless communication device. Based on the information about the at least one user, a sensor network feature may be determined by the processor 2310 to be applied via the light fixture network. The processor 2310 may then dynamically collect and monitor an appropriate parameter from a sensor associated with at least one of the light fixtures in the light fixture network. Responsive to this monitoring, it may be automatically arranged by the processor 2310 for at least one electronic message to be transmitted.

Referring again to FIG. 23, the programs 2312, 2314 may be stored in a compressed, uncompiled and/or encrypted format. The programs 2312, 2314 may furthermore include other program elements, such as an operating system, a database management system, and/or device users used by the processor 2310 to interface with peripheral devices.

As used herein, information may be "received" by or "transmitted" to, for example: (i) the sensor network platform 2300 from another device; or (ii) a software application or module within the sensor network platform 2300 from another software application, module, or any other source.

In some embodiments (such as shown in FIG. 23), the storage device 2330 stores a user database 2360, a network database, 2400, and/or a historical database 2370. An example of a database that may be used in connection with the sensor network platform 2300 will now be described in detail with respect to FIG. 24. Note that the database described herein is only an example, and additional and/or different information may be stored therein. Moreover, various databases might be split or combined in accordance with any of the embodiments described herein.

Referring to FIG. 24, a table is shown that represents the network database 2400 that may be stored at the sensor network platform 2300 according to some embodiments. The table may include, for example, entries defining a network of light fixtures. The table may also define fields 2402, 2404, 2406, 2408, 2410 for each of the entries. The fields 2402, 2404, 2406, 2408, 2410 may, according to some embodiments, specify: a network identifier 2402, a light fixture identifier 2404, a description 2406, sensors 2408, and a status 2410. The information in the enterprise database 2400 may be created and updated, for example, based on information received from a user, light fixtures, and/or user communication hubs.

The network 2402 might be, for example, a network identifier, communication address, or any other information that can associated with a light fixture with a remote user network. The light fixture identifier 2404 may be, for example, a unique alphanumeric code identifying an energy efficient light fixture. The description 2406 might, for example, indicate entity manufacturer that produced the light fixture, a room where the fixture is located, or any other information associated with the light fixture. The sensors 2408 might indicate what type of data is available from each light fixture (e.g., motion data, temperature data, sound information, etc.). According to some embodiments, the sensor 2408 might further indicate whether or not an Extendable Sensor Mount ("ESM") is installed for that particular sensor. The status 2410 might indicate, for example, whether the light fixture is currently on, off, in standby mode, dimmed, etc. As used herein, the phrase "standby mode" might indicate, for example, that a lighting element is off and the fixture is "listening" for further instructions, sensing user movements, etc. The information in the network database 2400 may, for example, be used to control and/or receive information from light fixtures in a home network.

The following illustrates various additional embodiments of the invention. These do not constitute a definition of all possible embodiments, and those skilled in the art will understand that the present invention is applicable to many other embodiments. Further, although the following embodiments are briefly described for clarity, those skilled in the art will understand how to make any changes, if necessary, to the above-described apparatus and methods to accommodate these and other embodiments and applications.

Although specific hardware and data configurations have been described herein, note that any number of other configurations may be provided in accordance with embodiments of the present invention (e.g., some of the information associated with the databases described herein may be combined or stored in external systems). Moreover, note that some or all of the embodiments described herein might be installed, collect, analyze, and/or display information about sensor network features in substantially real time. For example, protection features might be analyzed on a daily basis (e.g., by comparing current values to other situations at a similar time of day, with a similar number of people in a house for a similar length of time). As a result of this analysis, adjustments might be automatically applied to one or more algorithms or rules (e.g., to improve the user's experience). Similar adjustments might be made on an hourly, weekly, or any other periodic basis. According to some embodiments, sensor network features may be user-selected and/or automatically determined using a business rules engine. Note that the system might automatically prioritize selections when multiple users are present in near field occupancy zone (e.g., the users are in the same room). Moreover, remote access might let a user set and/or re-set (e.g., to a previously set state) the system, including remote access associated with system support and service functionality. Still further information about one residence may be used to update and refine protections algorithms for other, un-related residences (to improve the overall user experience for everyone).

The present invention has been described in terms of several embodiments solely for the purpose of illustration. Persons skilled in the art will recognize from this description that the invention is not limited to the embodiments described, but may be practiced with modifications and alterations limited only by the spirit and scope of the appended claims.

What is claimed is:

1. A system, comprising:

a light bulb, including:

a base adapted to be coupled to a power socket, a body portion connected to the base and housing lighting circuitry, a communication element, and a receiving element, the lighting circuitry supporting at least one lighting element to provide illumination, the communication element configured to exchange information with at least one remote device, and the receiving portion adapted to receive and hold an extendable sensor mount, and a cover connected to the body portion, the cover including an opening comprising a flexible seal; and an extendable sensor mount, including:

a first end inserted through the flexible seal of the opening in the cover and attached to the receiving portion of the light bulb, and a second end, opposite the first end, positioned outside the cover and extendable with respect to the light bulb; and a sensor coupled to the second end of the extendable sensor mount, wherein data collected by the sensor is to be transmitted to the at least one remote device via the communication element.

2. The system of claim 1, wherein the sensor is to be powered via the base when coupled to the power socket.

3. The system of claim 1, wherein the lighting element is associated with an energy efficient light emitting diode light fixture and the at least one remote device is associated with at least one of: (i) a user communication hub co-located with a light fixture network, including the light bulb, and (ii) one of the plurality of light fixtures wherein the light fixture network, including the light bulb, comprises a mesh network topology.

4. The system of claim 1, wherein the communication element is associated with at least one of: (i) a wireless communication device, and (ii) a device that communicates via the base when coupled to the power socket.

5. The system of claim 1, wherein the receiving portion is associated with at least one of: (i) a heat sink, (ii) an anchor attached to a body of the light bulb, (iii) a threaded socket, and (iv) a prong receiving socket.

6. The system of claim 1, wherein the second end is extendable with respect to the light bulb via at least one of: (i) a degree of freedom providing an ability to be positioned away from the light bulb, (ii) a telescoping movement, (iii) a hinge or pivot element, and (iv) a flexible portion.

7. The system of claim 1, wherein the sensor is associated with at least one of: (i) a passive infra-red motion sensor, (ii) a microphone, (iii) an ambient light sensor, (iv) a temperature sensor, (v) a humidity sensor, (vi) an air quality sensor, (vii) an allergen sensor, (viii) a carbon dioxide sensor, (ix) a smoke detector, (x) a camera, (xi) a video camera, (xii) an infra-red camera, (xiii) a forward looking infra-red thermographic camera, and (xiv) a mold spore sensor.

8. The system of claim 7, wherein a plurality of sensors of different types are coupled to the second end of the extendable sensor mount.

9. A light bulb, comprising:

a base adapted to be coupled to a power socket;

lighting circuitry supporting at least one lighting element to provide illumination;

a communication element to exchange information with at least one remote device;

a bulb cover having an opening to receive at least a portion of an extendable sensor mount, wherein the opening comprises a flexible seal, and a receiving portion to receive a first end of the extendable sensor mount.

10. The light bulb of claim 9, wherein the lighting element is associated with an energy efficient light emitting diode light fixture.

11. The light bulb of claim 9, wherein the communication element is associated with at least one of: (i) a wireless communication device, and (ii) a device that communicates via the base when coupled to the power socket.

12. The light bulb of claim 9, wherein the receiving portion is associated with at least one of: (i) a heat sink, (ii) an anchor attached to a body of the light bulb, (iii) a threaded socket, and (iv) a prong receiving socket.

13. A method, comprising:

selecting an information exchange element from a plurality of potential information exchange elements of different types;

coupling the information exchange element to a second end of an extendable information exchange element mount, the extendable information exchange element mount having a first end opposite the second end;

inserting the first end of the extendable information exchange element mount through a flexible seal in a bulb cover to connect to a receiving portion of a light bulb;

coupling a base of the light bulb to a power socket; and adjusting a position of the information exchange element with respect to the light bulb.

14. The method of claim 13, wherein the information exchange element is associated with at least one of: (i) a passive infra-red motion sensor, (ii) a microphone, (iii) an ambient light sensor, (iv) a temperature sensor, (v) a humidity sensor, (vi) an air quality sensor, (vii) an allergen sensor, (viii) a carbon dioxide sensor, (ix) a smoke detector, (x) a camera, (xi) a video camera, (xii) an infra-red camera, (xiii) a forward looking infra-red thermographic camera, (xiv) a mold spore sensor, (xv) an audio speaker, (xvi) a projector, and (xvii) a wireless signal boosting, extending, or relaying device.

* * * * *